US006751959B1

(12) United States Patent
McClanahan et al.

(10) Patent No.: US 6,751,959 B1
(45) Date of Patent: Jun. 22, 2004

(54) SIMPLE AND COMPACT LOW-TEMPERATURE POWER CYCLE

(75) Inventors: Timmons S. McClanahan, Florence, AL (US); Michael C. Crim, Florence, AL (US)

(73) Assignee: Tennessee Valley Authority, Knoxville, TN (US)

( * ) Notice: Subject to any disclaimer, the term of this patent is extended or adjusted under 35 U.S.C. 154(b) by 0 days.

(21) Appl. No.: 10/314,135

(22) Filed: Dec. 9, 2002

(51) Int. Cl.[7] ..... F01K 7/32; F01K 25/08; F01K 13/00; F03G 7/00

(52) U.S. Cl. ..... 60/670; 60/647; 60/651; 60/671; 60/676

(58) Field of Search ..... 60/647, 651, 670, 60/671, 676

(56) References Cited

U.S. PATENT DOCUMENTS

| | | | | |
|---|---|---|---|---|
| 781,481 | A | | 1/1905 | Windhausen, Jr. |
| 1,632,575 | A | | 6/1927 | Abendroth |
| 3,479,817 | A | | 11/1969 | Minto |
| 3,953,971 | A | | 5/1976 | Parker |
| 3,986,362 | A | | 10/1976 | Baciu |
| 4,100,744 | A | | 7/1978 | De Munari |
| 4,109,469 | A | | 8/1978 | Carson |
| 4,192,145 | A | | 3/1980 | Tanaka |
| 4,358,930 | A | * | 11/1982 | Pope et al. ..... 60/647 |
| 4,422,297 | A | * | 12/1983 | Rojey ..... 60/651 |
| 4,465,610 | A | * | 8/1984 | Enjo et al. ..... 252/67 |
| 4,557,112 | A | * | 12/1985 | Smith ..... 60/651 |
| 4,562,995 | A | * | 1/1986 | Enjo et al. ..... 60/651 |
| 4,651,531 | A | * | 3/1987 | Enjo et al. ..... 60/651 |
| 5,617,738 | A | * | 4/1997 | Ikegami et al. ..... 62/509 |

OTHER PUBLICATIONS

Solomon D. Tetelbaum; Comparative Characteristics of the High Efficiency Supercritical Bottoming Cycle; IGTI–vol. 8, ASME Cogen–Turbo ASME 1993, pp. 445–452.

* cited by examiner

*Primary Examiner*—Sheldon J. Richter
(74) *Attorney, Agent, or Firm*—Sughrue Mion, PLLC

(57) ABSTRACT

A simple, compact, and relatively efficient thermodynamic power cycle system and process for extracting heat from a heat source stream and converting a portion of the heat to mechanical power. The system and process are composed of the same series of four processing units or steps found in the most basic form of a Rankine power cycle: (1) heating (means) of a pressurized working fluid to produce a superheated gas, (2) expansion (means) to a lower pressure to produce power, (3) condensation (means) of the low pressure gas to a liquid, and (4) pumping (means) of the liquid to high pressure to complete the cycle. The working fluid is heated under pressures above critical. The working fluid must have a critical temperature more than 40° F. lower than the temperature of the heat source stream and a normal boiling point less than 32° F.

48 Claims, 6 Drawing Sheets

SIMPLE AND COMPACT LOW-TEMPERATURE POWER CYCLE

BACKGROUND OF THE INVENTION

1. Field of the Invention

The field of the invention is a thermodynamic power cycle in which the working fluid (also called motive fluid) is energized by externally applied heat. Within that field, the present invention is a process in which the working fluid in the course of power production reaches a pressure and a temperature above that at which its vapor and liquid have the same density (i.e., a fluid state that is above its critical pressure and temperature, also called supercritical conditions). The present invention is also a process in which the working fluid is other than water or steam. Ammonia is the working fluid of choice for most applications contemplated for the present invention, but other fluid types which, like ammonia, have boiling points below 32° F. at a pressure of one atmosphere, absolute, may also be selected for reasons of obtaining greater efficiency, operability, or economics.

2. Description of the Prior Art

Many industrial processes have flowing streams of liquids, solids, or gases that contain heat which must be exhausted to the environment or removed in some way to facilitate proper operation of the process. Typically, the process designer for these industrial processes will use heat exchange devices to capture the heat and recycle it back into the process via other process streams. Often, however, there are not streams suitable to capture and recycle this heat, because they are either already too high in temperature or they contain insufficient mass flow. Any heat which cannot be recycled into the process is typically referred to as waste heat. Most often waste heat is simply discharged to the environment, either directly as an exhaust stream, or indirectly via a cooling medium, such as cooling water.

One method of utilizing waste heat is to raise steam in a boiler to drive a turbine, a known method well recognized by practitioners of the art known as the Rankine cycle. The steam-based Rankine cycle, however, is only economic when it is applied to heat source streams that are relatively high in temperature (generally 600° F. or higher) or are large in overall heat content. In other words, high thermal efficiency or significantly large scale is generally needed to make the Rankine cycle economic. A major reason for this is that efficient removal of waste heat from a process stream requires boiling water at multiple pressures/temperatures to capture heat at multiple temperature levels as the heat source stream is cooled. This complexity is costly from standpoints of both equipment cost and operating labor. Overall, the steam-based Rankine cycle is either too expensive or too inefficient or some combination of the two to be applied to streams of small flow rate and/or low-temperature.

Some process developers have substituted other working fluids for steam in the Rankine cycle to obtain greater compatibility with heat source streams of low or moderate temperature. Typically, an organic fluid such as propane is used. Although improved over steam, organic cycles present the same fundamental inadequacies of the Rankine cycle described above.

Accordingly, there is a need for a relatively simple, low-cost, and relatively efficient method of capturing and utilizing waste heat from process streams that are low in temperature or low in overall heat content.

The advantages of using supercritical conditions in a power cycle have been recognized for many years. For example, a 1927 patent (U.S. Pat. No. 1,632,575, Jun. 14, 1927, Abendroth) describes a system for generating power from supercritical steam. Even then the inventor, Abendroth, did not claim supercritical steam power generation as the invention, rather he claimed a variation of it.

Abendroth, '575, above, highlighted the advantages of supercritical steam generation when he stated, "The advantage of this process resides in the fact that a separation of steam and liquid of equal temperatures but of different physical properties cannot take place at any point in the process. In this way the dangers are eliminated which are caused by the well-known ebullition or boiling phenomena." In other words, a heated fluid does not boil when it is at a pressure above critical, instead the fluid simply transitions from liquid to vapor as its temperature rises through the critical temperature. Indeed, the properties of the liquid and the vapor are identical at the critical temperature. And, although the dangers of boiling are well-understood and easily controlled in today's power plants, boiling requires specialized equipment to separate the liquid phase from the vapor phase. Under supercritical conditions, in which no such separation takes place, the equipment is simplified. Moreover, as will be explained later in detail, supercritical operation can have thermal efficiency advantages over boiling operation. Generally, with most working fluids, multiple pressure boiling stages are needed to achieve the same thermal efficiency that supercritical operation can achieve in one stage.

A disadvantage of the supercritical steam cycle is that the heat source must be above 705° F., the critical temperature of water. This eliminates many moderate and low temperature heat sources as potential applications for the cycle. A supercritical ammonia cycle, however, is applicable to these heat sources because of the relatively low critical temperature of ammonia, 270° F.

The use of ammonia as a working fluid is also known. In U.S. Pat. No. 781,481, Jan. 31, 1905, Windhausen, Jr., a basic form of Rankine cycle is described in which ammonia is the working fluid. The patent covers generally all pure working fluids in which their normal boiling temperature is less than 32° F. These "low boiling" fluids are, in general, a good match for Rankine cycle applications in which the heat source temperature and/or the condensing temperature is relatively low. Since Windhausen's patent was first issued in 1905, there have been variations of using ammonia and other low boiling liquids to capture low temperature heat. Many of these were patented during the late 1970's and early 1980's at the height of the energy crisis in the U.S. Exemplary of these is an invention to convert natural heat sources (solar, geothermal, etc.) to power (U.S. Pat. No. 4,100,744, Jul. 18, 1978, DeMunari), an invention to produce power from low temperature heat sources in a petroleum refinery (U.S. Pat. No. 4,109,469, Aug. 29, 1978, Carson), an invention to exploit natural temperature differences on the earth such as a mountain top and a desert valley (U.S. Pat. No. 3,953,971, May 4, 1976, Parker), and an invention that is another variation of the use of natural heat sources (U.S. Pat. No. 4,192,145, Mar. 11, 1980, Tanaka).

In 1969, William L. Minto discussed the value of low boiling compounds as working fluids in his patent of a Low Entropy Engine (U.S. Pat. No. 3,479,817, Nov. 25, 1969, Minto). Minto's engine was in essence a basic Rankine cycle with certain low boiling compounds, mainly halogenated hydrocarbon compounds such as carbon tetrachloride, as the universe of working fluids from which to select. (One example of an acceptable working fluid for Minto's invention, chlorodifluoromethane, is specifically cited as a potential selection of working fluid for our invention.) Minto's engine vaporizes the working fluid by ordinary means of boiling at subcritical pressure. In his patent, Minto stated that low boiling compounds could endow a power cycle with certain characteristics when he stated that an "object of the present invention is to provide an improved [working fluid] . . . characterized by its efficiency, simplicity, [and] compactness . . . ". Minto did not recognize, however, that the use of supercritical operating conditions could further increase thermal efficiency of the process and enhance simplicity by eliminating boiling and the attendant boiler equipment.

Only one patent was discovered which mentioned the concept of using ammonia as a working fluid with supercritical operating conditions. In U.S. Pat. No. 3,986,362, Oct. 19, 1976, Baciu, a process is described in which power is generated from a geothermal heat source. The process employs a two step heat transfer arrangement in which hot water from the geothermal heat source warms an intermediate heat storage material, liquid sodium, which in turn heats a pressurized working fluid stream of ammonia to supercritical conditions. The working fluid ammonia is expanded and then reheated by a second two step heat transfer arrangement like that just described. This reheat method increases the efficiency of the cycle but also makes it more complex in that the energy in the heat source stream must be divided in some manner to provide heat to both the primary, or high pressure, turbine's working fluid and to the reheat, or low pressure, turbine's working fluid. The cycle includes the generation of low temperature thermal energy as well as electrical energy. The patent claims make no reference to supercritical operation nor to ammonia as the working fluid, although from the detailed description presumably, a supercritical ammonia cycle is a preferred embodiment of the process.

Outside of patent literature, a 1993 paper describes a supercritical ammonia cycle as a simpler and more efficient alternative to both the multi-pressure steam cycle and to the Kalina cycle, which uses variable composition mixtures of ammonia and water in a subcritical cycle [Solomon D. Tetelbaum, "Comparative Characteristics of the High Efficiency Supercritical Bottoming Cycle," *American Society of Mechanical Engineers,* IGTI-Vol. 8, 1993, pp. 445–452]. The main application for the cycle described by Tetelbaum was as a bottoming cycle to capture waste heat from the high temperature (>900° F.) exhaust leaving a combustion turbine. Because the working fluid enters the expansion turbine at a high temperature, near that of the combustion turbine's exhaust gas, the working fluid leaving the cycle's expansion turbine is also relatively hot (about 400° F.) and thus contains a significant quantity of sensible heat. To make effective use of this sensible heat, a regenerative method is used in which the condensed ammonia from the recirculation pump is preheated by indirect heat exchange with the hot ammonia exhaust. Similar to the reheat method described above, the regenerative method increases efficiency but adds complexity and cost to the cycle.

SUMMARY OF THE INVENTION

The present invention is a thermodynamic power cycle system and process to be used for the purpose of extracting a flow of heat from a hot stream of gas, liquid, solid, or mixture of these, hereafter referred to as a heat source stream, and converting a portion of this extracted flow of heat to mechanical power. Heat is extracted from the heat source stream to a working fluid in a heat exchanger in which the two streams flow in opposite (countercurrent) direction. The working fluid flows through the heat exchanger at a pressure above its critical pressure and emerges above its critical temperature. The use of supercritical conditions permits the working fluid to transition from liquid to gas at its critical temperature without boiling. (Or, stated another way, the liquid and gas at the critical temperature have identical properties and are indistinguishable.) This supercritical step simplifies the equipment compared with Rankine cycle by eliminating the boiler section. The boiler section of a Rankine cycle normally contains added equipment of such size and complexity that small heat source streams cannot be practically or economically utilized.

The present invention in its simplest form is comprised of four means to perform four process steps through which the working fluid flows in a closed-loop cycle: (1) means for transferring heat from the heat source stream to the working fluid, (2) means for expanding the working fluid to generate mechanical power and the means for expanding also providing a means for throttling the working fluid to maintain a pressure within the means for transferring heat that is greater than the critical pressure of the working fluid, (3) means for cooling to condense and subcool the working fluid after the means for expanding, and (4) means for returning the working fluid to the means for transferring heat. These are the only four means or steps in the system or process in which energy is added to or removed from the working fluid in the form of heat or work. Since the means used in the system of the present invention so closely parallel the process steps of the present invention, the same will often be treated interchangeably.

Other steps typically used in Rankine cycle, which are often needed to promote good thermal efficiency and which have the drawback of increasing cost and operating complexity, such as multiple stages of boiler pressures, reheat of turbine exhaust, and deaeration, are not necessary in the present invention.

The present invention, by virtue of the properties of the working fluid and the nature of the process flow scheme, is simple, compact, and relatively efficient for heat sources of low to moderate temperature (about 210° F. and higher). This combination permits heat to be economically converted to power from heat source streams which are relatively low in heat content, i.e., either low in temperature or mass flow or a combination of the two. One way to express this combination numerically is by using the concept of availability of energy to do work based on the second law of thermodynamics. By this definition, the present invention is economically viable using heat source streams with as low as about 5 million Btu per hour of available heat content (per unit of time). Such streams of low available heat content are not normally economic when used as heat sources with Rankine cycle.

The working fluid of choice is ammonia for those applications in which the heat source stream is in the temperature range of about 400° F. to about 700° F. This is the range contemplated for many applications of the present invention. However, for heat source temperatures outside this range or for unusual applications within this range, other fluid types may be selected for use in the present invention for reasons of obtaining greater efficiency, operability, or economics.

It is the principal object of this invention to provide a low-cost, simple to operate, relatively efficient, and compact system and process for the conversion of a flow of heat to power.

Detailed objects of the invention are as follows:

It is an object of this invention to provide a system and process which are capable of economically capturing heat from more than one heat source stream within the same facility.

Another object of this invention is to permit, if desired by the user, all of the system and processing equipment (except for the heat transfer means and the heat source stream) to be mounted on one or more portable transportation means.

A related object of this invention is to permit, for a system and process unit of about 4 MW or less in net power output, all of the system and processing equipment (except for the heat transfer means and the heat source stream) to be located on a single portable transportation means.

A still further object of this invention is to permit portable transportation means units to be designed and constructed according to a standardized set of specifications.

It is a further object of this invention to provide a system and process which are sufficiently simple in operation such that it can be started and operated automatically under normal or routine circumstances of operation with the use of conventional computer controls, without benefit of human intervention.

Another object of this invention is to provide a system and process with relatively fast startup capability.

Another object of this invention is to provide a system and process for making power, which, by virtue of their inherent simplicity, may be applied to existing heat source streams within an existing facility without significant change to the operation of the existing facility.

It is an object of this invention to provide a system and process for converting the latent heat of condensing vapors within a heat source stream into power.

A further object of this invention and a more specific application is to utilize this invention to simplify the heat recovery from a hot gas generated by a coal gasifier, and in particular, the type of coal gasifier in which the hot coal gas is quenched in water.

Another object of this invention is that it may be applied as a bottoming cycle to convert waste heat from a topping cycle into power.

It is a further object of this invention that it may be applied to the hot exhaust gas from a combustion turbine system (i.e., application as a bottoming cycle with a combustion turbine as the topping cycle).

A further and more specific object of this invention is that it may be applied to recuperated combustion turbine units, i.e., combustion turbine units in which the hot exhaust has been partially cooled by heat exchange with combustion air.

A still further and more specific object of this invention is that it may be applied to combustion turbines used for the generation of peak loads, i.e., special purpose combustion turbines, also called peaking units, which are employed to rapidly provide electric power to a power transmission grid during intermittent periods in which electric power demand is unusually high.

Still further and more general objects and advantages of the present invention will appear from the detailed description set forth below, it being understood, however, that this more detailed description is given by way of illustration only, and not necessarily by way of limitation since various changes therein may be made by those skilled in the art without departing from the true spirit and scope of the present invention.

Thus, in one aspect of the invention there is provided a thermodynamic power cycle system for extracting a flow of heat from a heat source stream and generating mechanical power from the flow of heat by means of a working fluid flowing within a closed-loop cycle comprising:

means for transferring heat from the heat source stream to the working fluid such that the working fluid warms from a first temperature to a second temperature that is more than 30° F. greater than the critical temperature of the working fluid wherein the working fluid has a critical temperature more than 40° F. lower than the temperature of the heat source stream and has a normal boiling point less than 32° F.;

means for expanding the working fluid and converting work of expansion of the working fluid to mechanical power; said means for expanding and converting work of expansion also throttling the working fluid such that a pressure of the working fluid exceeds the critical pressure of the working fluid by an amount greater than 5% of the critical pressure of the working fluid as the working fluid emerges from the means for transferring heat;

means for cooling to condense and subcool the working fluid after the means for expanding;

means for returning the working fluid to the means for transferring heat;

the means for transferring heat, the means for expanding, the means for cooling, and the means for returning being the only four means in which energy is removed from or transferred into the working fluid in the form of heat or work.

In preferred aspects of the invention:

The heat source stream comprises a gas, liquid, solid or mixture thereof.

There is further provided: an additional means for throttling the working fluid after the means for transferring heat and before the means for expanding; means for controlling the flow rate of the working fluid; means for containing excess of the working fluid in the liquid state after the means for cooling to condense the working fluid; means for redirecting the flow of the working fluid after the working fluid has exited the means for transferring heat to bypass the means for expanding, the means for redirecting the flow containing a means for throttling the working fluid such that a pressure of the working fluid exceeds the critical pressure of the working fluid by an amount greater than 5% of the critical pressure of the working fluid as the working fluid emerges from the means for transferring heat.

A means for increasing the pressure of the heat source stream to restore the pressure lost by the heat source stream as it flows through the means for transferring heat is provided.

Further preferred aspects of the invention include embodiments where: there exists two or more heat source streams, with the thermodynamic power cycle system comprising additional means for transferring heat, each of which means for transferring heat is dedicated to a single heat source stream; wherein the working fluid is divided into separate streams, with each of the separate streams being dedicated to a separate means for transferring heat; and wherein the separate streams of working fluid, after having been heated by transfer of heat from the heat source streams, are combined into a single working fluid stream;

the heat source stream is a gas, and the system further comprises ducting means to transport the gas to the means for transferring heat and wherein the means for increasing the pressure is a fan or compressor;

the working fluid is ammonia, chlorodifluoromethane, sulfur dioxide or bromotrifluoromethane;

the working fluid is ammonia;

the working fluid is chlorodifluoromethane;

the working fluid is sulfur dioxide.

Still further preferred aspects of the invention include embodiments where: all means of the system except for the means for transferring heat are mounted on one or more portable transportation means;

the mechanical power is 4 MW or less and wherein there is only one transportation means;

the working fluid is ammonia for the embodiment wherein there is only one transportation means;

the working fluid is chlorodifluoromethane for the embodiment wherein there is only one transportation means;

And still further aspects of the invention include embodiments where: the heat source stream is a gas which contains a condensable vapor;

the heat source stream is a stream of pressurized hot gas which has been quenched in water;

the stream of pressurized hot gas has been produced by the reaction of coal and oxygen in a coal gasifier;

the working fluid is ammonia for the embodiment wherein the stream of pressurized hot gas has been produced by the reaction of coal and oxygen in a coal gasifier;

the mechanical power is utilized to provide supplemental drive power to an air compressor of an air separation unit, the air separation unit being employed to provide oxygen to the coal gasifier;

the working fluid is ammonia for the embodiment wherein the mechanical power is utilized to provide supplemental drive power to an air compressor of an air separation unit, the air separation unit being employed to provide oxygen to the coal gasifier And still further preferred aspects of the invention include embodiments where: the heat source stream is generated by a topping cycle;

the topping cycle a comprises a combustion turbine and wherein the heat source stream is exhaust gas from the combustion turbine;

the combustion turbine is a peaking unit;

the working fluid is ammonia for the embodiment wherein the combustion turbine is a peaking unit;

the working fluid is sulfur dioxide for the embodiment wherein the combustion turbine is a peaking unit;

the exhaust gas has been partially cooled by heat exchange with compressed air;

the working fluid is ammonia for the embodiment wherein the exhaust gas has been partially cooled by heat exchange with compressed air.

DETAILED DESCRIPTION OF THE INVENTION

Figure 1:
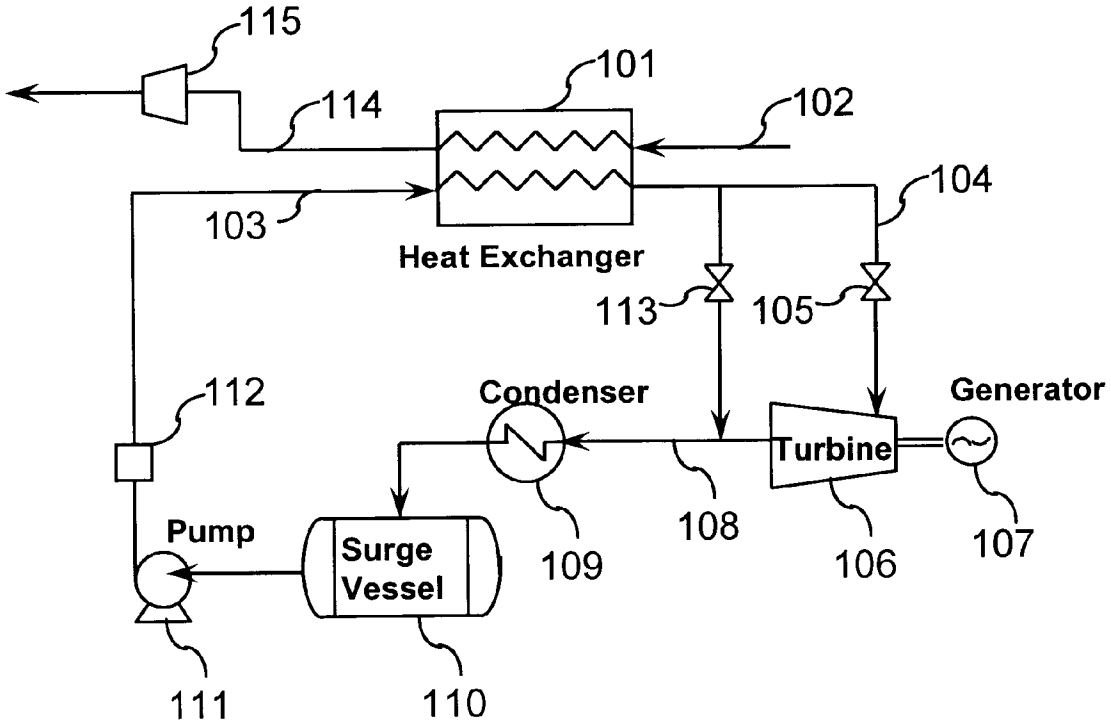
FIGS. 1 and 1A are flow diagrams of the present invention.

Although similar to the earlier discussed prior art supercritical cycles, the present invention and the practice thereof relates to a heretofore unrecognized, new, and novel approach to the use of supercritical fluids for the generation of power. The physical properties of some fluids are such that a relatively large amount of power can be produced from a relatively small volumetric flow, thus creating a process for generating power that is relatively small and low in cost. With chlorodifluoromethane as the working fluid, power can be obtained from heat source streams with temperatures as low as about 290° F. With ammonia as the working fluid, power can be obtained from heat source streams across a broad range of moderate temperatures, about 400° F. to about 700° F. That which has not been recognized by other inventors is that the unique properties of these fluids and others permit a process to be designed that is simple, compact, and relatively low in cost without sacrificing to any large degree the thermal efficiency of the process. This characteristic simplicity and compactness permits the process flow scheme, most of the equipment, and the process operation to be standardized regardless of the application. Standardizing the design, particularly if the design is simple and compact as the present invention offers, has a distinct economic advantage. Our studies show that a small, 2–4 MW generic version of the present invention, in which most of the process equipment is assembled in a shop and skid-mounted, is very economically attractive as a source of electric power. A small skid-mounted process such as this would permit many heretofore unusable heat source streams that are low or moderate in temperature or low in total heat content to be exploited for power production. Shop assembly and skid-mounting of the equipment into an integrated, transportable unit are techniques that provide significant cost savings over custom-built, field-assembled processes.

Another benefit of a simple, standardized process is that, with conventional computer-driven process controls, most functions of the process can be automated. This reduces operating labor costs and allows the present invention to be applied at sites where the operating staff is unfamiliar with power generation technology.

As earlier indicated, the present invention in its simplest form is comprised of four system means or process steps through which the working fluid flows in a closed-loop cycle: (1) heat transfer means, (2) expansion means, (3) cooling means, and (4) means for returning the working fluid to the heat transfer means. Also, optionally included in the present invention to facilitate control and operation of the cycle are the following means and corresponding process steps: (1) storage capacity means to hold an excess of liquid working fluid, (2) throttling means (in addition to that provided by the expanding means) to maintain supercritical pressure in the heat exchanger, (3) bypass means and pressure control means to allow the working fluid to bypass the expansion step during startup and shutdown, (4) pressure elevating means (e.g., a fan, compressor, or pump) to restore the pressure lost by the heat source stream as it flows through the heat transfer means, and (5) flow controlling means to control the circulation rate of the working fluid.

The present invention, together with further objectives and advantages thereof, will be better understood from a consideration of the following description taken in connection with the accompanying drawings and examples.

FIG. 1 is a process flowsheet generally illustrating the principles of the present invention. The process operates in a closed-loop cycle. Operation in a closed-loop cycle in the context of the present invention simply means that the working fluid flows in a continuous manner through the elements of the system when the process is in operation and does not leave the process loop which includes heat transfer means, throttling means, expanding means, cooling means and return means. While theoretically it would be possible to temporarily interrupt the process of the present invention so that flow is not continuous, at present we see no benefit to interrupting such continuous flow except when the process is to be off-line. In similar fashion, working fluid could be removed from the system during times of closed-loop cycle at normal operation, but at present we see no benefit to such removal of working fluid. However, the claims of the present application should be construed in a manner which would not exclude such temporary interruption of the closed-loop cycle or minor removal or addition of working fluid from the closed-loop.

In heat exchanger 101, heat is transferred via indirect heat exchange from the heat source stream, 102, to the working fluid stream, 103. Stream 103 is at a temperature near ambient, having been cooled at a previous point in the cycle by an external cooling medium. Stream 103 enters 101 as a liquid at a pressure greater than its critical pressure and emerges as a supercritical vapor stream 104. Pressure control valve 105 maintains the pressure in heat exchanger 101 above critical during periods of operation when the flow rate of the working fluid is less than the flow prescribed by design. During periods of operation when the flow rate is equal to or greater than the flow rate prescribed by design, this valve will be fully open. The working fluid enters expansion turbine 106 to produce work of expansion to drive electric generator 107 or, alternatively, to drive some other device requiring power such as a pump or a compressor. Stream 108 exits expansion turbine 106, having been cooled by work of expansion, and is condensed substantially completely, more preferably completely, to a liquid in condenser 109. Condenser 109 also subcools the liquid by about 2–5° F. below saturation to increase the net positive suction head to the circulating pump 111. An external cooling medium (not shown), such as water or air generally used by industrial facilities, is used to condense and subcool the working fluid. Vessel 110 provides storage capacity for an excess of the working fluid beyond that which is the minimum volume needed for the present invention to function. Pump 111 imparts flow and pressure to the working fluid to return the working fluid to heat exchanger 101. A flow control device, 112, such as a valve or a speed controller for the pump sets the circulation flow rate of the working fluid. A bypass line and pressure control valve, 113, is included to permit expansion turbine 106 to be bypassed during startup, shutdown or other times of major transition in the operation of the present invention. The cooled heat source stream, 114, leaving heat exchanger 101, is directed back to the process from which the heat source stream came, or, alternatively, stream 114 is directed to device 115, which is a fan, compressor, pump or other means of elevating the pressure to restore the pressure lost by the heat source stream as it flows through heat exchanger 101.

The present invention is applicable to heat source streams containing a liquid, gas, solid, or a mixture of these. The term gas is meant to also include vapor, which wholly or in part condenses into a liquid as the heat source stream is cooled. Vapor as a heat source is a particularly important application for the present invention as is illustrated in Example II presented later. Solids are preferably applicable in a mixture with gases or liquids, because, by strict definition, a pure solid cannot flow as a stream. However, a pure solid that generates a flow of heat by means of internal reaction (such as a nuclear reactor core) or that receives a flow of heat from an external heat source is a potentially applicable form of heat source for the present invention and such a solid is therefore included within the definition of heat source stream.

Two important operating parameters for the present invention are the pressure and temperature of stream 104, the working fluid as it leaves heat exchanger 101. This pressure and temperature must exceed the working fluid's critical pressure and temperature, respectively, during normal operation. (The critical temperature of a gas is the temperature above which it is impossible to liquefy the gas no matter how high the applied pressure. The critical pressure is the minimum pressure needed to liquefy a gas at its critical temperature. The term supercritical means above or higher than critical; and the term "supercritical conditions" means that the fluid is in a state in which both the critical pressure and critical temperature are exceeded.) To avoid unstable operation, which may occur as a result of large fluctuations in density of the working fluid whenever stream 104 is too close to the critical pressure, the pressure of stream 104 should be at least 5 percent greater than the critical pressure, as measured in absolute numbers, and the temperature of stream 104 should be at least 30° F. greater than the critical temperature.

The working fluid may be any fluid having a critical temperature at least 40° F. less than the temperature of the heat source stream and having a normal boiling point of 32° F. or less. (Normal boiling point is defined as the temperature at which the fluid boils when the fluid pressure is 14.696 psia, standard atmospheric pressure.) The required 40° F. minimum difference between the critical temperature and the temperature of the heat source stream is based on maintaining the required minimum 30° F. temperature difference between the critical temperature and the temperature of the working fluid, stream 104, as described above, plus a minimum additional 10° F. difference for heat transfer to occur between stream 104 and the heat source stream, stream 102. A maximum 32° F. normal boiling point assures that the condensing pressure is significantly above atmospheric pressure (i.e., at least 5 psi above atmospheric at 50° F., the lowest contemplated temperature of condensation), thus ensuring that the present invention will retain certain important features that meet the objects of the invention, namely, compactness of the equipment and the lack of a vacuum anywhere within the working fluid during operation of the present invention.

Within the constraints of the above limitations, the type of working fluid to use in the present invention is a choice of the plant designer. As those skilled in the art of plant design will appreciate, such a choice will vary depending on parameters of the application such as temperature of the heat source stream, mass flow of the heat source stream, and temperature of the cooling medium. To put this choice in the broadest perspective, the choice of working fluid is simply one of many design options that a designer will consider in seeking a plant that is the most economic for the application.

For purposes of illustrating the effects of specific working fluids on the present invention and its practice, all numerical references regarding specific working fluids discussed herein are for the theoretically pure fluid. These numerical references are presented by way of illustration only and are not meant to imply that the fluid must be pure in order to be acceptable for use as a working fluid in the present invention. The working fluid used in the present invention need not be at the extremely high purity level of a chemical reagent, but generally speaking the process of the present invention will be most practical with a working fluid which is about as high or higher than the purity of a standard commercial grade of the chemical or working fluid involved. The primary reason for this is that this will permit the inevitable loss of working fluid over time to be replenished without worrying about constantly changing the nature of the basic chemical composition of the working fluid and such a commercial grade of chemical is easily available. However, the working fluid of the present invention is selected primarily with regard to the physical characteristics and properties that the working fluid must exhibit in the closed-loop cycle of the present invention, and thus in theory there is no reason why blends of various working fluids could not be used to achieve the objects of the present invention.

One working fluid that our computer simulations have shown to produce excellent economic results across a broad range of heat source temperatures (generally 400° F. to 700° F.) and sizes (about 1 MW and larger) is ammonia. In order that those skilled in the art may better understand how the properties of the working fluid contribute to fulfilling the objects of the invention, an analysis of ammonia as a working fluid is presented below. As those skilled in the art will readily understand, the numerical results of this analysis will differ for other types of working fluids, but the general principles will still apply.

The present invention can, of course, be practiced without the use of computer simulations by using principles well known in the art. In fact, process simulation programs can be easily written without undue experimentation, though commercially available process simulation software such as ChemCAD® is readily available and simple to use.

The low critical temperature of ammonia, 270° F., allows the process to function at low temperature and to utilize low or moderate temperature heat source streams. During heat transfer from the heat source stream to the working fluid, by maintaining the pressure of ammonia above its critical pressure, 1636 psia, no boiling occurs inside the heat exchanger. Instead the working fluid's temperature rises continuously as heat is added. The physical state of the fluid transitions from liquid to vapor as the temperature of the fluid rises through its critical temperature of 270° F. This rise in temperature with heat input is close to linear, unlike a boiling process (or Rankine cycle) in which the fluid rises in temperature until it reaches the boiling point, then remains at a constant temperature as heat is input until all of the liquid has been converted to vapor, and then resumes rising in temperature as the vapor is superheated. As those skilled in the art of heat exchange are aware, a nearly linear rise of temperature of the working fluid suppresses the formation of undesirable pinch points, i.e., points of zero temperature difference between the two fluids being exchanged. Generally, with boilers, effective and efficient utilization of the available heat from the heat source requires multiple stages of boiling to avoid encountering pinch points in the design.

The pressure at which ammonia condenses is relatively high compared with many other working fluids, which contributes to the compactness of the process. For example, at a condensing temperature of 85° F., ammonia condenses at a pressure of 167 psia and steam condenses in a deep vacuum, about 0.6 psia. The higher condensing pressure of ammonia suppresses the relative volumetric flow of the working fluid, which, in turn, lowers the relative size of the expansion turbine and condenser equipment.

By way of technical definition, the terms expansion or expanding in the context of an expansion turbine or a means for expanding refers to the expansion of the working fluid to produce work and the conversion of that work to mechanical power. During expansion, the working fluid cools as heat is converted to mechanical power. (It should be noted that, strictly speaking, work and heat are forms of energy, not power, which is a flow of energy. However, those skilled in the art understand that because the working fluid flows, the work or heat derived from the working fluid also flows and is therefore properly expressed as power.) The term throttling, while similar in some aspects to expanding, has a distinct and separate definition as used herein. Throttling is the use of a narrowing or restriction in the flow path of the working fluid which acts to increase or maintain the pressure upstream of the restriction. For any given flow of the working fluid, an increase in throttling, which is to say a greater restriction to the flow, will increase the pressure upstream of the throttling device. As those skilled in the art are familiar, any expansion turbine will provide both work of expansion to produce power and a throttling effect, which maintains pressure of the working fluid upstream of the expansion turbine. However, a working fluid can also be throttled without producing work of expansion by simply restricting the flow with a valve, such as the use of valve 105 in the present invention. Further discussion of valve 105 regarding its purpose and relationship to expansion turbine 106 can be found later in this section.

As with many steam cycle applications, the present invention can be and typically would be designed and operated such that the working fluid is cooled by expansion in the expansion turbine all the way to the condensing temperature. In this case, as with steam, essentially all of the heat loss from the cycle would be lost as latent heat of condensation of the working fluid in the condenser. In this respect, ammonia offers another advantage. The latent heat of ammonia is relatively low, about half that of steam on an equal molar basis.

A further advantage of ammonia is that there is no vacuum pressure used anywhere within the working fluid during operation of the present invention. With steam and other working fluids that condense at a vacuum pressure at ambient temperatures, vacuum conditions at the condenser cause air to be leaked into the working fluid from the surrounding atmosphere through equipment seals. A deaerator system is needed with these other working fluids to remove the air during operation. With the present invention, however, no deaerator is needed because ammonia condenses well above atmospheric pressure. Furthermore, because of the very low normal boiling point of ammonia (−28° F.), the process equipment remains pressurized when idle, even in subfreezing winter-time conditions. Therefore, no vacuum pump is needed to remove air from the condenser system prior to startup. This facilitates rapid startup of the system.

The relatively high condensing pressure of ammonia has a further advantage over working fluids that condense at a vacuum, such as steam. With these latter fluids, the surface of the condensed fluid must be elevated, often 30 feet or more, in order to deliver sufficient net positive suction head to the circulating pump (i.e., pump 111). This elevation adds greatly to the cost of the equipment because of the need to include structural steel, platforms, ladders, and other structural items to elevate the condenser and associated piping and instrumentation. With ammonia, however, subcooling of the liquid slightly below its condensing temperature can achieve the same effect as elevation. For example, subcooling the saturated liquid to a temperature of 83° F. from 85°

F., lowers the vapor pressure of the liquid by about 5 psia, which is the equivalent of adding about 20 feet of elevation. (In contrast, subcooling of saturated water to 83° F. from 85° F. adds about the equivalent of only 0.1 feet of elevation.) Thus the present invention allows the liquid surface elevation to be low, i.e., under ten feet relative to the pump elevation (which is normally at the lowest point in the process structure). In turn, this low elevation profile keeps the cost of structural components relatively low and permits the present invention to retain the desired characteristic of compactness. The terms subcool or subcooling, as used herein, mean further cooling the condensed working fluid to a temperature which allows the elevation of the surface of the working fluid above pump 111 to be lowered substantially without incurring a loss of net positive suction head, a term well known in the art of pumping fluids. The degree to which subcooling is used as a substitute for elevation of the surface of the working fluid is a choice of the system designer based on practical and economic considerations. Subcooling thus permits pump 111, when the same is in operation, to forward the working fluid to the heat transfer means without any substantial degree of cavitation, i.e., cavitation which might harm the process operation or equipment. Cavitation can result in a loss of pump performance, and by the inherent nature of cavitation can cause rapid changes in flow which could result in shutdown of the process of the present invention or even physical damage to the pump 111. As is well known in the art, cavitation is vaporization of a liquid within a pump, and while is generally impossible to avoid all possible occurrences of cavitation, one object of subcooling is to provide sufficient net positive suction head in order to reduce cavitation to a point where it has no noticeable impact on the process or equipment used in the practice of the present invention.

Essentially, when idle, the system of the present invention is ready to start as soon as the heat source stream becomes available. Warming of the working fluid to supercritical temperature may occur in as little time as it takes to make one pass through the heat exchanger. Thus the present invention can be rapidly started in those cases in which immediate power is needed.

With ammonia as the working fluid, the minimum temperature of heat source streams to which the present invention is applicable is about 310° F., 40° F. above the critical temperature of ammonia (the minimum needed to meet the basic requirements of a working fluid for the present invention, as described above). In practice, however, the lowest temperature applicable to the present invention is determined as a matter of economics. The larger the heat source stream, the lower the acceptable temperature can be because of the economics of scale. In general, for most applications of the present invention, the heat source temperature should be at least 400° F.

The maximum temperature of heat source streams is unlimited from the standpoint of theoretical process operation. However, as the temperature of the heat source increases, the present invention is subject to a mechanical limitation in that very high pressure operation is needed to make full use of the available heat. In general, as either temperature or total heat content or a combination of the two increase, other types of thermodynamic power cycles would begin to exhibit superior thermal efficiency and better overall economics. Roughly, 700° F. is a practical upper limit for most heat source streams. However, if the heat source stream is very small or some other special condition of operation applies, such as the need for rapid startup, the present invention may still prove to be more economic with higher temperature heat source streams than other types of power cycles.

With some applications of the present invention, other working fluids will be preferred over ammonia, particularly in those applications where the heat source stream is at a temperature outside the range of preferred application for ammonia (400° F.–700° F.).

Among the possible fluids, two have been identified as good alternatives to ammonia: chlorodifluoromethane and sulfur dioxide. Table I lists the key properties of these two compounds and compares them with the properties of ammonia.

TABLE I

| Fluid | Chemical formula | Critical pressure | Critical temperature | Condensing pressure @ 85° F. | Normal boiling point |
|---|---|---|---|---|---|
| Ammonia | $NH_3$ | 1636 psia | 270° F. | 167 psia | −28° F. |
| Chloro-difluoro-methane | $CHClF_2$ | 721 psia | 205° F. | 172 psia | −41° F. |
| Sulfur dioxide | $SO_2$ | 1143 psia | 316° F. | 65 psia | 14° F. |

Because of its relatively low critical temperature, chlorodifluromethane should be considered as the working fluid in applications in which the heat source temperature is less than 400° F. and above 290° F. Moreover, the low critical pressure of chlorodifluoromethane provides a practical design benefit in that it makes it possible to select a design pressure that is sufficiently low to prevent condensation of liquid in the expansion turbine during expansion. Condensation can be a practical problem for the mechanical design of the expansion turbine because of the tendency for liquid droplets to erode the turbine blades. Above 400° F. for the heat source stream, ammonia would normally be preferred simply for the reason that it produces more net power, mainly because the parasitic power required to pump chlorodifluoromethane is significantly higher than that required for ammonia.

The above cited temperature of 290° F. is roughly the coldest temperature that is still within the preferred range of application for the present invention. However, colder temperatures are theoretically possible with proper selection of working fluid. For instance, bromotrifluoromethane, also known as Freon 13B1, with a critical temperature of 152° F., permits operation of the present invention with heat source streams as cold as about 210° F. However, at this temperature, the thermal efficiency of the present invention becomes very low—in the range of 4 to 5 percent. Economic operation would be possible only in unusual cases in which the heat source stream is very large or in which the wholesale price of electricity is unusually high.

Sulfur dioxide should be considered as the working fluid in applications in which the heat source stream is roughly 600° F. or higher. Sulfur dioxide is excellent as a working fluid in that it will, in theory, produce more net power than ammonia under similar conditions of design and heat source application. Below 600° F., this superior performance can only be obtained by allowing condensation to occur in the expansion turbine, which is problematic for the mechanical design of the turbine. Furthermore, sulfur dioxide, as shown in Table I, condenses at a much lower pressure than ammonia. This makes the process less compact and the expansion turbine more expensive, in that more stages of expansion are required in the expansion turbine. As those skilled in the art of design optimization will appreciate, the determination of whether to select sulfur dioxide or ammonia as the working fluid can only be determined by comparing the results of detailed designs to determine if the power advantage of sulfur dioxide outweighs its disadvantages with respect to the cost of the equipment. As a general rule, however, as both heat source temperature and plant scale increase, sulfur dioxide will begin to exhibit superior economics.

Although the choice of working fluid is important in achieving the objects of the invention, the mechanical design and arrangement of the process equipment is also important to achieving these objects as described below.

Heat exchanger 101 is a heat exchange device of proper engineering design and material selection for the two fluids being exchanged. The exchange of heat takes place indirectly across a solid barrier between the two streams, generally such barrier being a metal tube wall. Flow of the two streams is in opposite, or countercurrent, direction through the heat exchanger such that the working fluid is heated to a temperature near to that of the heat source stream, and simultaneously, the heat source stream is cooled to a temperature near to that of the working fluid as it enters the heat exchanger. In most cases of heat exchanger design, the working fluid would be directed to flow inside multiple, small-diameter tubes because this is the least expensive way to confine a high pressure fluid. The heat source, which will usually be lower in pressure than the working fluid, would be directed to flow outside the tubes within an outer shell of the heat exchanger. The design and layout of the heat exchanger's tubes will require no special consideration for boiling since no boiling of the working fluid occurs. However, design considerations may dictate that the tube layout and tube diameter change at some intermediate point within the heat exchanger because of the large change in volumetric flow which occurs as the working fluid is heated and transitions from liquid to vapor.

Figure 1A:
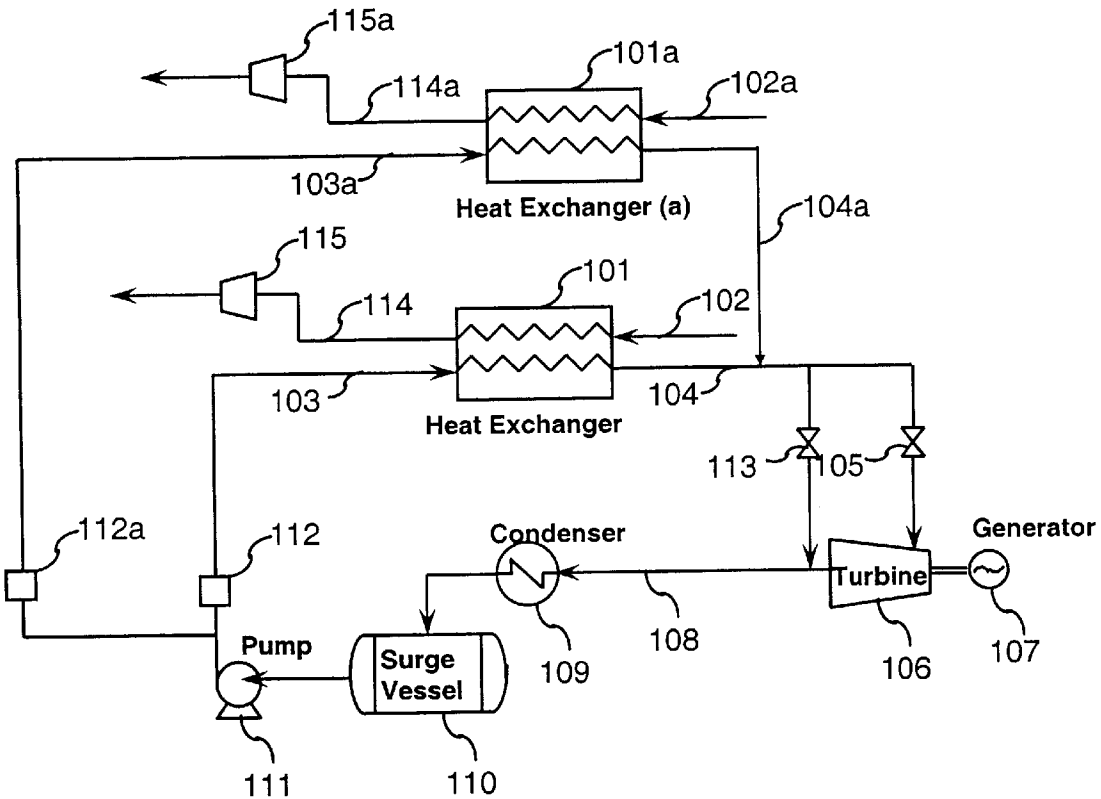

As illustrated in FIG. 1A, multiple units of heat exchanger 101 may also be used if more than one heat source is available in the same general facility. In the illustrated case, the working fluid is split into two streams of parallel flow and each stream routed to a separate heat source with separate heat exchanger, from each of which the separate streams are recombined into a single stream for conversion into power. (In FIG. 1A, elements of the second stream are identified by the same reference numerals as those used for the single stream of FIG. 1, but with the subscript "a".) In most cases, the flow of each separate stream of the working fluid must be controlled independently in order to obtain the desired temperature of each stream as it leaves each respective heat exchanger. The heat sources can be dissimilar in temperature, pressure, or physical state because each heat source is exchanged separately. For example, the present invention could be applied simultaneously to streams as different as a flue gas and a liquid chemical stream under high pressure.

In most cases, to minimize disruption to the operation of an existing facility, good engineering practice would dictate that the heat exchanger(s) be located at the existing locations of the heat source stream(s), i.e., the heat source streams are not rerouted. The remaining process units of the present invention may be placed anywhere else within the facility. Indeed, this is an important feature of the present invention, in that most of the power production equipment may be located at a significant distance from the existing facility if safety reasons or other reasons warrant. The high pressure of the working fluid is the property which permits long distances to be practical, because any pressure losses in the piping runs are a minor proportion of the total pressure and, as such, have a relatively small negative impact on power production. The present invention also permits, by virtue of its simplicity of operation and design, for the design of the piping runs to and from the heat exchanger(s), and the heat exchanger(s) themselves, to be welded construction throughout all of the sections in contact with ammonia without need for valves, fittings, instrumentation, or other screwed or mechanically sealed connectors to be present which may otherwise leak the working fluid.

The equipment used for expansion turbine 106 is not limited to any particular type; it may be any mechanical device of proper design and size which converts the work of expansion of the working fluid to mechanical energy. This includes, but is not limited to, centrifugal expanders, which are generally used in small applications, and axial-flow machines, which are most often used for large applications. For applications of the present invention in which very high pressures of the working fluid are used, a non-continuous expansion device such as a device that contains expansion chambers with piston drivers may prove to be the most practical and economic.

The pressure of the working fluid in heat exchanger 101 must exceed its critical pressure to suppress boiling and to operate in a manner consistent with the purpose of the present invention. Otherwise, the operating pressure has no maximum limit from the standpoint of theoretical process operation. A fluid above its critical temperature remains as a vapor and thus is theoretically suitable for expansion in a turbine regardless of pressure. In practice, however, the choice of operating pressure is subject to the practical design limitations of the process equipment and overall economic considerations. In particular, one limitation on the use of higher pressure is the potential for the working fluid to condense at the low pressure, cold end of the expansion turbine. Higher pressure means that the expansion turbine operates with a greater pressure ratio of expansion, resulting in more cooling of the working fluid and thus more condensation. Some condensation is acceptable in a properly designed expansion turbine, but excessive condensation can erode the turbine blades or produce other forms of mechanical damage.

As a general rule, the higher the temperature of the working fluid as it enters the expansion turbine, the higher the pressure can be without causing excessive condensation. To illustrate this point, consider an expansion turbine operating on ammonia with a 0.85 adiabatic efficiency and which discharges to a condenser operating at a pressure of 167 psia and 85° F. If the working fluid ammonia enters the turbine at a temperature of 450° F., then, according to the physical properties of ammonia and its behavioral characteristics when undergoing work of expansion, the maximum pressure that this stream can be without causing more than 5 percent of the fluid at the cold end of the turbine to condense is about 2261 psia. By way of comparison, if the fluid temperature is 550° F., 100° F. higher, the maximum pressure for 5 percent condensation is about 3792 psia. If no condensation were allowed, then these maximum pressures would be about 1788 psia and 3016 psia, respectively.

The bypass line and valve, 113, which permit bypass of the working fluid around the expansion turbine 106, provide an important operational benefit, particularly whenever rapid startup is desired and/or when the heat source stream flows intermittently. (An example of this is an application in which the present invention is employed as the bottoming cycle for a peak load power generating combustion turbine, as described in Example IV, presented later.) For instance, when the heat source stream is not available but is expected to begin flowing soon, the bypass line permits full flow circulation of the working fluid in the liquid state. The valve maintains pressure of the liquid in the heat exchanger at or above the designated normal operating pressure. In this mode, the system is ready for the heat source stream to begin flowing and then normal operation can commence as rapidly as possible. After the heat source stream flow has begun and as soon as the working fluid reaches an operationally acceptable supercritical temperature as it emerges from heat exchanger 101, valve 105 in the normal flow path is opened slowly to initiate flow through the expansion turbine 106. Simultaneously, valve 113 is closed slowly as flow is transferred to the turbine.

It is possible for the present invention to function without the bypass line and valve 113. In this case, startup is initiated with the heat source stream already flowing through heat exchanger 101. When pump 111 is started, liquid working fluid enters heat exchanger 101 and begins raising the pressure inside the heat exchanger. Valve 105 is closed, which permits the pressure to increase behind it. Because the working fluid will boil during this phase of pressure increase during startup, heat exchanger 101 must be of a design and construction which can withstand the internal vibration and forces of boiling during the length of time needed for startup. Furthermore, expander 106 must be of a design and construction which can withstand a rapid introduction of hot, vaporized working fluid passing through valve 105 when valve 105 begins opening to maintain the desired pressure in heat exchanger 101. Because of these special process equipment requirements, it is expected that applications of the present invention in this form (i.e., no bypass line and valve 113) will be limited. However, this form of the present invention does offer an advantage: startup and transition to normal operation can be effected by simply starting pump 111.

Valve 105 provides a means of throttling the working fluid to maintain the desired supercritical pressure in heat exchanger 101 during periods of operation in which the flow rate of the working fluid is significantly less than that prescribed by design. Generally, such periods of operation would only be necessary whenever the flow or temperature of the heat source stream itself is significantly less than that prescribed by design. Whenever the flow of the working fluid is near or higher than the design flow, expansion turbine 106 provides, by virtue of its resistance to flow through its various internal components, the means of throttling. In other words, the expansion turbine provides a dual role, both as means of expansion to produce power and as means of throttling. In this case, valve 105 is opened to its fullest extent possible and provides little or no throttling of the working fluid. A variation of the present invention can be envisioned in which valve 105 is eliminated from the design. This variation would be possible for particular applications in which the flow of the working fluid can always be maintained near to or above the design flow because there is always sufficient heat available from the heat source stream. Further variations can be envisioned in which valve 105 is eliminated and replaced with an adjustable form of flow throttling that is part of the expansion turbine itself (such as guide vanes commonly used with commercial turbines).

Figure 5:
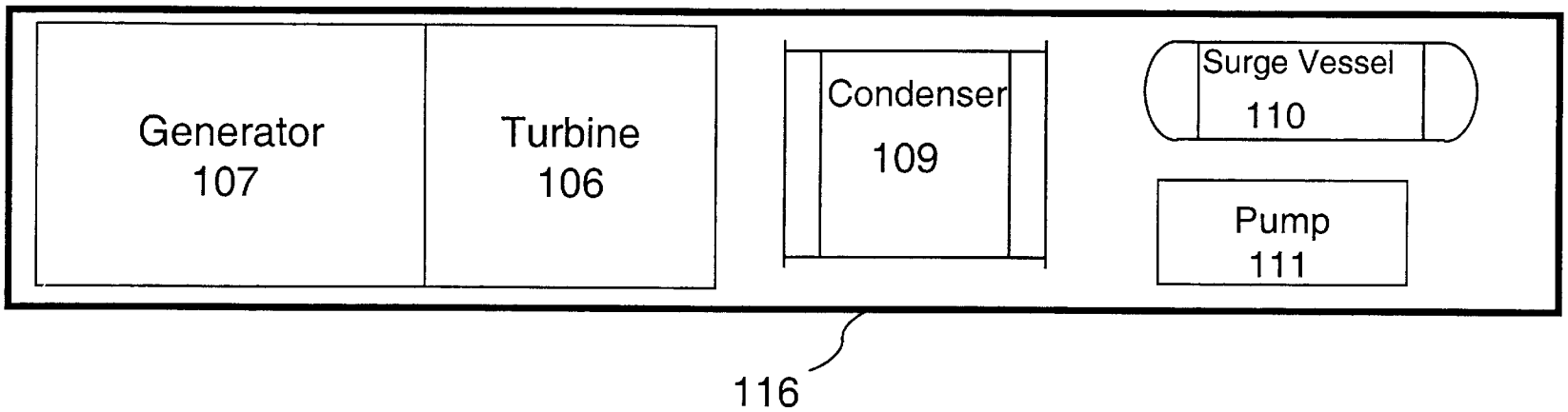
FIG. 5 illustrates a portable embodiment of the invention.

An advantage of the present invention is that all of the process equipment (except for the heat exchanger) may be mounted on one or more portable transportation means. One form of portable transportation means commonly known to those skilled in the art is a portable skid 116 as shown in FIG. 5. A portable skid is essentially a free-standing platform on which the process equipment of the present invention is mounted. For practical purposes of transportation, the physical dimensions of a portable skid are limited to that which can be transported by railroad car or by truck over most highways of the United States as defined by the U.S. Department of Transportation regulations. The use of portable skids has an economic advantage in that most of the process hardware can be assembled in a shop rather than at its operational site in the field. Two features of the present invention make skid-mounting a practical alternative to field construction. First is the invention's simplicity, in that very few large items of process equipment are needed. Second is the invention's compactness. The relatively high working pressure and the high condensing pressure of the working fluid keep the volumetric flow of the working fluid relatively low through the turbine and condenser, and therefore the size of the equipment and interconnecting piping is relatively small. Subcooling of the condensed working fluid, discussed earlier, also contributes to the compactness of the present invention. Subcooling permits the elevation of the liquid surface above pump 105 to be relatively small (under ten feet, if desired, by the designer) such that the height of the process equipment above the surface of the portable skid is relatively low (compared with steam cycles). A related object of this invention is to permit, for a process unit of about 4 MW or less in net power output, all of the processing equipment (except for heat exchange with the heat source stream) to be located on a single portable skid.

Another advantage of the present invention is that the process equipment (also called means or elements in the claims) that is mounted on the portable skid may be standardized, i.e., designed and constructed according to a fixed set of specifications without regard to a specific application to a heat source stream. Only the heat exchanger, which is separate from the portable skid, need be designed for any particular application. The design of the heat exchanger must be such that working fluid can be processed by the heat exchanger and returned to the portable skid at a flow rate, pressure, and temperature within an acceptable range of normal operation for the standardized equipment. Of course, the heat source stream must be sufficiently large in heat content and high in temperature to meet these requirements. This, in effect, is a limitation of standardization, because it is unlikely that a heat source stream will exactly match the requirements of a standardized unit. Therefore, some heat will not be converted to power which may otherwise be used if all of the equipment were custom designed. However, the use of standardized equipment eliminates many costs associated with custom design and thus standardization is expected to produce an economic advantage with many applications.

Another advantage of the present invention is that operation of the process may be automated, i.e., made capable of operation under normal or routine circumstances without benefit of human intervention. An automated version of the present invention is one in which human intervention is limited to preparing the equipment for normal operation and then authorizing the unit to operate by activating an electronic switch. All remaining startup and normal operation activities are then carried out by instruction to the operating equipment via electronic signal from a process control computer. No claim is made with respect to the process control computer itself. Rather it is claimed that the simplicity of the present invention, having only a single circulating loop of the working fluid, permits an automated version of the process to function with state-of-the-art computer controls already in existence. Example I, which contains an explanation of a typical startup sequence, illustrates the simplicity of the startup procedure.

A specific application of this invention is to produce power from a flowing stream of hot pressurized gas which has been generated in a coal gasifier. A coal gasifier is a vessel in which coal or some other carbon containing solid material is converted to a gas by reacting with oxygen. Of particular importance is the type of coal gasifier in which the hot gas is quenched in water. The resulting water vapor-laden gas is the heat source stream to which this invention is applied (as further detailed in Example II below). A related object is to utilize the power generated from this application as supplemental drive power for the main air compressor in an air separation unit, which supplies oxygen to the coal gasifier. An air separation unit is a process in which oxygen is extracted from air as a stream of high purity (usually over 90 percent by volume) oxygen. The main air compressor delivers air to the air separation unit at a pressure sufficient for the extraction process to take place.

The present invention may be applied as a bottoming cycle to convert waste heat from a topping cycle into power. A topping cycle is defined as any power cycle which utilizes a fuel as an energy source to produce power. A bottoming cycle is defined as any cycle which converts waste heat from the topping cycle into additional power. The two cycles taken together are often referred to as a combined cycle. Examples of topping cycles as defined here include combustion turbines, internal combustion engines, and fuel cells. Of particular interest is that the present invention may be applied to the hot exhaust gas from a combustion turbine (i.e., it is applied as a bottoming cycle with a combustion turbine as the topping cycle). A combustion turbine is a power generating system of equipment in which air from the atmosphere is compressed, a fuel is burned directly in the compressed air stream to produce a hot stream of combustion gas, and then the hot combustion gas is expanded to produce power. Of particular importance are those applications where the present invention is likely to be more economic or practical than the traditional bottoming cycle methods (such as the steam-based Rankine cycle). Examples of important applications for the present invention are: (1) small applications, in which the bottoming cycle produces less than about 10 MW of power; (2) recuperated combustion turbines, in which the hot exhaust after expansion to produce power has been partially cooled by heat exchange with compressed air, a method of heat recovery known as recuperation; and (3) peaking units, combustion turbines that operate intermittently to produce electric power during unusual periods of high electricity demand called peak loads. Typically, peak loads have a duration of less than a day. (*The McGraw-Hill Encyclopedia of Science & Technology,* $7^{th}$ edition, discusses the art of servicing peak loads with peaking units and defines these terms.) If a bottoming cycle is employed to meet the demands of peak loads, it must start quickly and automatically to be viable as an economic source of power. As illustrated in Example IV below, the present invention has these characteristics.

The present invention is also characterized by the process steps or methods (and attendant equipment items) that it does not require in order to function or to meet the objects of the invention. Such steps, which are employed in many Rankine cycle power generating plants, particularly steam plants, are obviated by the inherent simplicity of the present invention and the beneficial effect of the physical properties of the working fluids. The process steps or methods that are not used by the present invention include:

Boiler equipment, which is defined as equipment needed to facilitate the boiling operation other than the heat exchanger, such as a vessel to separate vapor from liquid, forced or natural circulation piping, forced circulation pumps, mist eliminators, and deionization equipment.

Vaporization of the working fluid at more than one discrete pressure level ("discrete pressure level" being defined as any pressure within a range of plus or minus 5 percent of an exact numerical pressure).

Deaeration (i.e., the removal of non-condensable gases that have entered the working fluid from the atmosphere during normal operation).

Reheat (i.e., warming of the working fluid between expansion turbine stages by adding heat to the working fluid from an outside heat source).

Recuperation (i.e., transferring heat from the warm working fluid exhaust leaving the expansion turbine, stream 108, to the relatively cool condensed working fluid, stream 103).

Elevation of the liquid surface of the condensed working fluid to a height more than 10 feet above the intake of pump 111.

Vacuum pressure operation and the attendant vacuum producing equipment.

EXAMPLES

In order that those skilled in the art may better understand how the present invention can be practiced, the following examples are given by way of illustration only and not necessarily by way of limitation, since numerous variations thereof will occur and will undoubtedly be made by those skilled in the art without substantially departing from the true and intended scope and spirit of the instant invention herein taught and disclosed.

Five examples are presented below, each illustrating a different application of the present invention.

The following design and operating parameters, except as noted, were used in all three examples, and are typical values for commercial applications:

Adiabatic efficiency of the expansion turbine: $Turb_{eff}$=85 percent

Total mechanical and generator losses: $M\&G_{loss}$=2 percent

Condensing temperature: $T_{cond}$=85° F. (105° F. in Example IV)

Adiabatic efficiency of the circulating pump: $Pump_{eff}$=80 percent

Electric motor efficiency: $Motor_{eff}$=90 percent

For each example, the gross electric power output of the expansion turbine and the gross electric power consumption by the circulating pump were calculated by the following formulas, respectively.

$$\text{Gross electric power output}=(\text{Theoretical expansion turbine power})\ (Turb_{eff}/100)((100-M\&G_{loss})/100)$$

$$\text{Gross pumping power used}=(\text{Theoretical pumping power})/(Pump_{eff}/100)/(Motor_{eff}/100)$$

where,

The theoretical expansion turbine power and the theoretical pumping power were both derived by determining the power derived from the reversible isentropic change in pressure of the working fluid. Properties of the working fluid were estimated by ChemCAD® process simulation software using equations of state. ChemCAD® also calculated all temperatures, pressures, flows, and other properties of streams cited in the examples. NOTE: Any references made herein to materials and/or apparatus which are identified by means of trademarks, trade names, etc., are included solely for the convenience of the reader and are not intended as, or to be construed, an endorsement of the materials and/or apparatus.

Total net power was calculated by the formula:

Net power=(Gross expansion turbine power)−(Gross pumping power)

Thermal efficiency figures cited in the examples were calculated by expressing the net power as a percentage of the available heat in the heat source stream (as a flow of heat), converted to units of electric power. Available heat is defined as all of the sensible and latent heat which could be extracted from the heat source stream if it were cooled to lowest temperature in the system, i.e., the same temperature at which the condenser operates, 85° F. (105° F. in Example IV).

EXAMPLE I

Example I illustrates the general case of extracting heat from a typical industrial heat source stream. A pressurized stream of hot water in the liquid state at 1000 psia, 500° F. and flowing at a rate of 200 gallons per minute represents the heat source. The working fluid of choice is ammonia.

Only three process design parameters need be selected for the cycle in Example I: (1) the temperature of the working fluid as it leaves heat exchange (stream 104 in FIG. 1), (2) the maximum pressure of the working fluid, and (3) the circulation rate of the working fluid. A temperature of 450° F. is selected for the working fluid, which, given the 500° F. temperature of the heat source, provides an adequate temperature difference of 50° F. for heat transfer at the hot end of the heat exchanger. A working fluid pressure of 1800 psia is selected, which, upon expansion in the expansion turbine 106 at an initial 450° F., yields a modest and acceptable level of 0.1 percent liquid in the expansion turbine exhaust. Finally, the circulation rate of the working fluid is selected to provide, with benefit of properly sized heat exchange equipment, a 50° F. temperature difference at the cold end of the heat exchanger. This figure is calculated to be about 59,500 pounds per hour.

During normal and steady state operation of the present invention, the operating conditions at points throughout the cycle are as follows (see FIG. 1 for references to line and equipment designation numbers). Stream 104 emerges from heat exchanger 101 at a temperature of 450° F. having been heated by the 500° F. heat source stream. Valve 113 is fully closed and valve 105 is fully open. At the calculated design flow rate of 59,500 pounds per hour for stream 104, the expansion turbine 106 by virtue of its design provides resistance to flow (i.e., throttling) such that the pressure in stream 104 is maintained at about 1800 psia. Upon expansion of stream 104 through expansion turbine 106 to a pressure of 167 psia, the working fluid, having been cooled by work of expansion, emerges saturated at 85° F. and contains about 0.1 percent liquid of condensation (stream 108). These conditions are calculated on the basis of obtaining 85 percent of the theoretical power from the isentropic expansion of ammonia. Gross power generated at the expansion turbine 106 shaft is 2397 kW. After deducting 2 percent for losses in the generator, gross electric power output from generator 107 is 2349 kW. Stream 108 is condensed in condenser 109 at a temperature of 85° F. by an external cooling source (such as cooling water at 60° F.). The pressure at which ammonia condenses at 85° F. is 167 psia, which sets the pressure at the discharge of expansion turbine 106. The working fluid liquid is also subcooled in condenser 109 to a temperature of 83° F. No accumulation or loss of fluid occurs in surge vessel 110 at steady state. Pump 111 increases the pressure of the working fluid to 1805 psia, which is 5 psi above the pressure at the entrance to expansion turbine 106. This 5 psi difference is to allow for a pressure drop due to flow of the working fluid through heat exchanger 101 and the attendant piping. Pump 111 is a type that provides a fixed volume of liquid per revolution of its drive shaft (i.e., a positive displacement pump). The prescribed circulation rate of 59,500 pounds per hour is set by controlling the rotational speed of the drive shaft of pump 111. Electric power consumed by the drive motor of pump 111 is 198 kW. The mechanical act of pumping the working fluid warms it slightly to about 90° F. from 83° F. Thus stream 103 has conditions of 90° F. and 1805 psia as it enters heat exchanger 101, completing the cycle as described.

In the above described cycle, the flow of energy into and out of the working fluid occurs only at four steps in the cycle: (1) heat exchanger, (2) expansion turbine, (3) condenser, and (4) pump. In the heat exchanger, energy flows into the working fluid from the heat source stream at the rate of 38.36 million Btu per hour. In the expansion turbine, energy flows out of the working fluid and is converted to mechanical energy at the rate of 8.18 million Btu per hour. The condenser, which also includes subcooling of the fluid after it has condensed, removes the bulk of the heat by rejecting it to an external cooling medium at the rate of 30.79 million Btu per hour. Finally, the pump, using an electric motor as the energy source, adds 0.61 million Btu per hour to the working fluid in the form of heat and pressure rise. As with all continuous cycles, there is no net accumulation or loss of energy by the working fluid as it makes a cycle during steady state operation. The total energy added to the fluid in steps 1 and 4, which is 38.97 million Btu per hour, is exactly matched by that removed in steps 2 and 3.

The present invention is also capable of operating under conditions which are significantly different from the above described normal conditions, a state of operation known as "off-design." Off-design operation is required whenever external conditions deviate from normal. There are only two points in the process where external changes can occur: (1) the heat source stream as it enters heat exchanger 101 and (2) the cooling stream for condenser 109. The heat source stream, 102, may vary in the quantity of heat it carries. This change in quantity of heat is manifested by the heat source stream as either a change in flow rate or a change in temperature or some combination of flow and temperature. If the quantity of heat falls, the circulation rate of the working fluid must be reduced by an amount necessary to maintain the maximum power output which can be achieved under the new conditions. This reduction in circulation rate will cause the pressure entering the expansion turbine 106 to be reduced below the normal operating pressure of 1800 psia. In this case, valve 105 is closed partially to assure that supercritical conditions a remaintained in heat exchanger 101 and that boiling inside the heat exchanger is avoided. In similar manner, if the quantity of heat rises, the circulation rate of the working fluid is increased by an amount necessary to maintain the maximum power output which can be achieved under the new conditions. However, this increase in circulation rate is subject to limitations of the system design to withstand the increase in pressure at the expansion turbine 106 entrance or the capability of the generator to generate the increased electric power. A change in cooling capacity in condenser 109, which is usually manifested as a change in the temperature of the cooling stream, will result in either higher or lower condensing pressure. Normally, no change in operation is required; the decrease or the increase in power output, respectively, is simply accepted. However, if the condensing pressure falls to a point at which the power output limitation is exceeded, or to a point at which there is more liquid condensate in the expansion turbine 106 outlet than acceptable by mechanical design of the turbine, the condensing pressure is raised as needed by limiting the cooling stream flow.

To demonstrate off-design operation in this example, consider the case in which the flow rate of the heat source stream is reduced by 20 percent to 160 gallons per minute from 200 gallons per minute. Condensing and subcooling temperatures in condenser 109 remain the same as above. The pressure in heat exchanger 101 is maintained at 1800 psia. Our process simulation estimates that the maximum power output under this new condition is achieved by reducing the working fluid circulation rate to 48,500 pounds per hour from 59,500 pound per hour. The pressure entering the expansion turbine 106 falls to about 1455 psia as a result of the reduced flow rate. Valve 105 is partially closed to maintain the desired 1800 psia pressure in heat exchanger 101. The temperature of the working fluid leaving the heat exchanger is estimated to be 456° F., and the temperature entering the expansion turbine 106 is 435° F., a 21° F. difference which is a result of constant enthalpy expansion across valve 105. (Although the working fluid is cooled as it passes through valve 105, no energy enters or leaves the working fluid at this step. This cooling is simply a phenomenon of the expansion of a non-ideal gas through a throttling valve in which no work is done.) Gross power generated at the expansion turbine 106 shaft is 1837 kW, about 23 percent lower than for normal operation described above.

An important objective of the present invention is to have the capability of being started quickly and simply. A typical startup of the present invention proceeds as follows: The heat source stream 102 has not begun flowing through heat exchanger 101, but it is available to be routed to the heat exchanger at the direction of the process operator. Pump 111 is energized to begin circulation of the working fluid. Flow passes through heat exchanger 101 and then through valve 113, bypassing expansion turbine 106 for now. Valve 105 is fully closed. Valve 113 is partially open to produce a restriction on the flow of the working fluid such that the normal operating pressure of 1800 psia or higher is maintained in the fluid as it exits heat exchanger 101. Flow continues through the normal flowpath to condenser 109, surge vessel 110, and back to pump 111 to complete the circuit. All of the working fluid is in the liquid state at this point in the startup sequence. Coolant flow (not shown) is started in preparation for heat input from the heat source stream.

On direction from the process operator, flow of the heat source stream 102 is initiated. The working fluid, stream 104, is expected to heat rapidly to normal operating temperature. The time required for this rapid warming of the fluid is only the time needed for one pass of the fluid through the heat exchanger plus some additional time to heat the structural materials (tubing, etc.) within the heat exchanger. As stream 104 rises in temperature, its density decreases, eventually making a transition from liquid to vapor. The opening in valve 113 is increased gradually to accommodate this change in density so as to maintain the desired operating pressure. As stream 104 nears the normal operating temperature of 450° F., valve 105 is opened partially to initiate flow to expansion turbine 106. Simultaneously, valve 113 is closed partially to maintain the desired operating pressure for stream 104. The process of opening valve 105 and closing valve 113 continues until all of the flow has been transferred to expansion turbine 106 and valve 113 is fully closed. This completes the startup sequence. As this startup description shows, startup is simple and rapid, an important feature of the present invention. After starting circulation of the fluid and initiating flow of the heat source stream, the entire startup sequence is controlled by setting the position of just two valves (valves 105 and 113). With benefit of modern process controls, this startup sequence can be automated and, if desired, initiated from a remote location.

Figure 2:
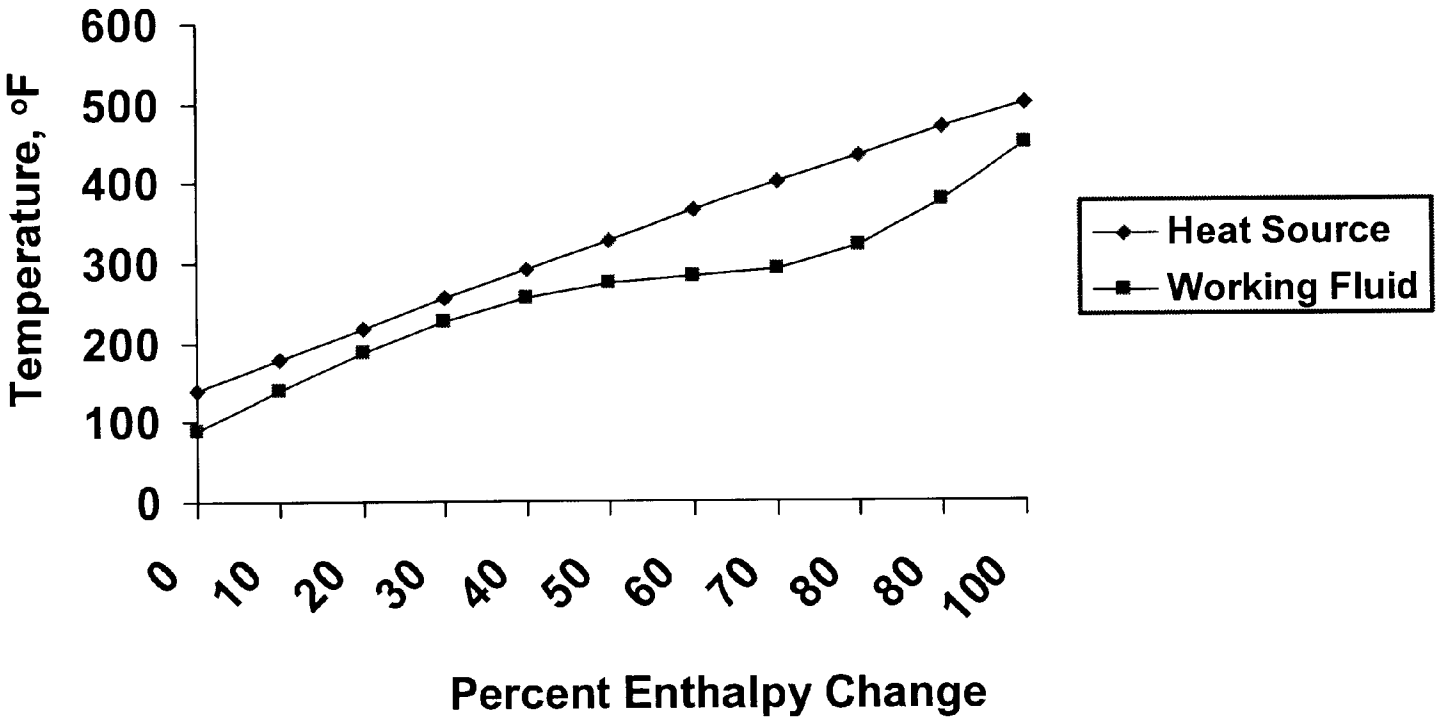
FIG. 2 is a graph of the heat source stream temperature and the working fluid stream temperature during heat exchange in Example I.

FIG. 2 shows the internal temperature profile along the length of heat exchanger 101 in this example. Temperature differences between the two streams remain acceptable throughout the exchanger. The smallest temperature difference between the two streams is about 30° F., and the largest is about 110° F. The log mean temperature difference (LMTD) weighted over the length of the exchanger is about 51° F., about the same as the LMTD of 50° F. based on the endpoints. Overall, FIG. 2 demonstrates the general acceptability of countercurrent exchange used by the present invention. FIG. 2 also demonstrates an important and desirable feature of the process, in that nearly all of the available heat is extracted from the heat source stream by virtue of it being cooled to a temperature near ambient. About 87 percent of the heat in the heat source stream is removed.

The calculated performance numbers for Example I are summarized as follows:

Gross electric power output=2349 kW

Gross pumping power used=198 kW

Net power=2151 kW

Thermal efficiency=16.7 percent

An important and much desired feature of the present invention is that it should be compact in size. One measure of this feature is the volumetric flow rate of the working fluid. The volumetric flow rate is roughly indicative of the physical dimensions of the process equipment. In Example I the flow rate of the working fluid upstream of expansion turbine 106 is calculated to be 15,700 cubic feet per hour ($ft^3/h$). Downstream, after expansion, this volume increases to 110,500 $ft^3/h$.

To put these figures and the performance numbers above into perspective, they are compared with the numbers from a similar model of the single-pressure Rankine steam cycle in which water/steam is the working fluid. The heat source stream was kept the same. Also, as with the present invention, the processing steps of the single-pressure Rankine steam cycle are limited to the same simple and basic configuration of four process steps in which the working fluid changes state: heat exchange, expansion, condensation, and pumping. For the heat exchange step of the steam cycle, three separate steps are necessary: (1) preheating of liquid water to the boiling point, (2) boiling to produce steam, and (3) superheating of the steam. In this respect, the heat exchange for the water/steam cycle case is more complex than that for the present invention, but for purposes of this exercise so that a comparison can be made, these three steps are considered to be one step of heat exchange.

To the extent possible, other design factors were kept the same, including adiabatic efficiency of the expansion turbine, total mechanical and generator losses, condensing temperature, adiabatic efficiency of the circulating pump, and electric motor efficiency. The working fluid was superheated to 450° F. in both cases. The average log mean temperature difference for heat exchange was kept the same at a value of 51° F.

Steam pressure entering the expansion turbine was set at 38 psia, which is the optimum pressure for the cycle. Higher and lower pressures produced less power. Expansion turbine exhaust pressure was set at 0.6 psia, the condensing pressure for steam at 85° F.

The results showed that the steam cycle produced significantly less power than the present invention: 1712 kW versus 2151 kW, net, respectively. Corresponding efficiency was also lower: 13.3 percent versus 16.7 percent, net, respectively.

Those skilled in the art will readily recognize that the steam cycle could be altered to produce more power by adding more stages of boiling. However, in so doing the steam cycle would lose the desired characteristic of simplicity exhibited by the present invention, a characteristic needed to make possible the objects of the invention described previously.

With respect to the volumetric flow of the working fluid, the difference between the present invention and the steam cycle is very large and very significant. The volumetric flow rates of the working fluid in the steam cycle, upstream and downstream of the expansion turbine, respectively, are 347,000 $ft^3/h$ and 12,239,000 $ft^3/h$. These volumes are more than two orders of magnitude larger than those described earlier for the present invention in this example. The relative sizes of the piping, the condenser, the expansion turbine, and all parts of the steam cycle involved in handling the working fluid in the vapor phase will have physical sizes similarly larger by about two orders of magnitude. For example, the vapor-carrying pipelines for the steam cycle will have cross-sectional flow areas of more than 100 times those of the present invention, which means that the respective diameters of the pipelines will be more than 10 times larger. The cross-sectional flow areas at points along the flow path inside the expansion turbine in the steam cycle will be similarly about 100 times larger than those points in the expansion turbine of the present invention.

In summary, Example I illustrates the simple, compact, and relatively efficient characteristics of the present invention. These three characteristics, with Example I providing the basis, may be expressed as follows: The present invention is (1) simple, in that there are only four basic process steps in which energy is added to or removed from the working fluid in the form of heat or work, (2) compact, in that the maximum volumetric flow of the working fluid is less than one percent of the maximum flow in a comparable steam cycle, and (3) relatively efficient, in that the thermal efficiency is greater than 16 percent, a reasonably high efficiency for a 500° F. heat source stream and greater than the efficiency of a comparable steam cycle.

EXAMPLE II

Example II illustrates the application of the present invention to extracting heat from a pressurized hot gas stream which has been quenched in water. More specifically, the intended application is a stream of quenched gas leaving an oxygen-fired coal gasifier. Typically such a gasifier operates at a temperature over 2000° F. in the firing zone where oxygen and coal are reacted. The gas is then quenched in a bath of water to bring the temperature down to manageable levels, typically 400° F. to 500° F., and to clean coal slag particles out of the gas. Most of the heat released during oxidation is thus retained by the quenched gas in the form of latent heat of water vapor mixed with the gas. This quenched gas must be cooled to near ambient to facilitate removal of sulfur-bearing compounds later in the process. Thus the recovery and re-use of this large quantity of latent heat during gas cooling is important for obtaining good thermal efficiency.

Normally, recovery of this latent heat requires a series of steps including two or more stages of medium- or low-pressure steam generation for subsequent power generation plus, in some cases, resaturation of the clean, sulfur-free gas. The present invention, however, when applied to the raw gas as a heat source, eliminates this series of steps and replaces them with a single power generating expansion turbine. Moreover, because of the compact size of the expansion turbine and the simplicity of the present invention, the power from the turbine can be used to provide supplemental drive power for the main air compressor in the gasification plant's air separation unit, the largest single user of electric power in the plant. Thus the inherent inefficiency of first generating electricity then and subsequently consuming it in an electric motor is eliminated. (The term supplemental drive power refers to power that offsets but does not completely eliminate the power provided by the main air compressor's electric drive motor. The air separation unit is a process which separates the oxygen and nitrogen in air into separate streams, each stream having a higher proportion of oxygen or nitrogen, respectively, than normally found in air. The main air compressor provides the necessary flow and pressure for the air to be separated within the air separation unit.)

Table II shows typical flowing conditions for a quenched gas stream from a coal gasifier operating at high pressure, near 1000 psia. Although the gas contains many compounds in small or trace quantities, for purposes of simplification, only the major components are included. The gas is saturated, such that any removal of heat is accompanied by both cooling in temperature and condensation of water. The quantity of water in the gas was estimated for the true, non-ideal gas case, and thus the gas composition estimate below contains more water vapor than would be predicted using steam tables.

TABLE II

| | |
|---|---|
| Pressure | 955 psia |
| Temperature | 471° F. |
| Flow | 852,000 lb/h |
| Composition | |
| $H_2O$ | 61 mole % |
| CO | 20 mole % |
| $H_2$ | 14 mole % |
| $CO_2$ | 4 mole % |
| $N_2$ | 0.5 mole % |
| $H_2S$ | 0.5 mole % |

Figure 3:
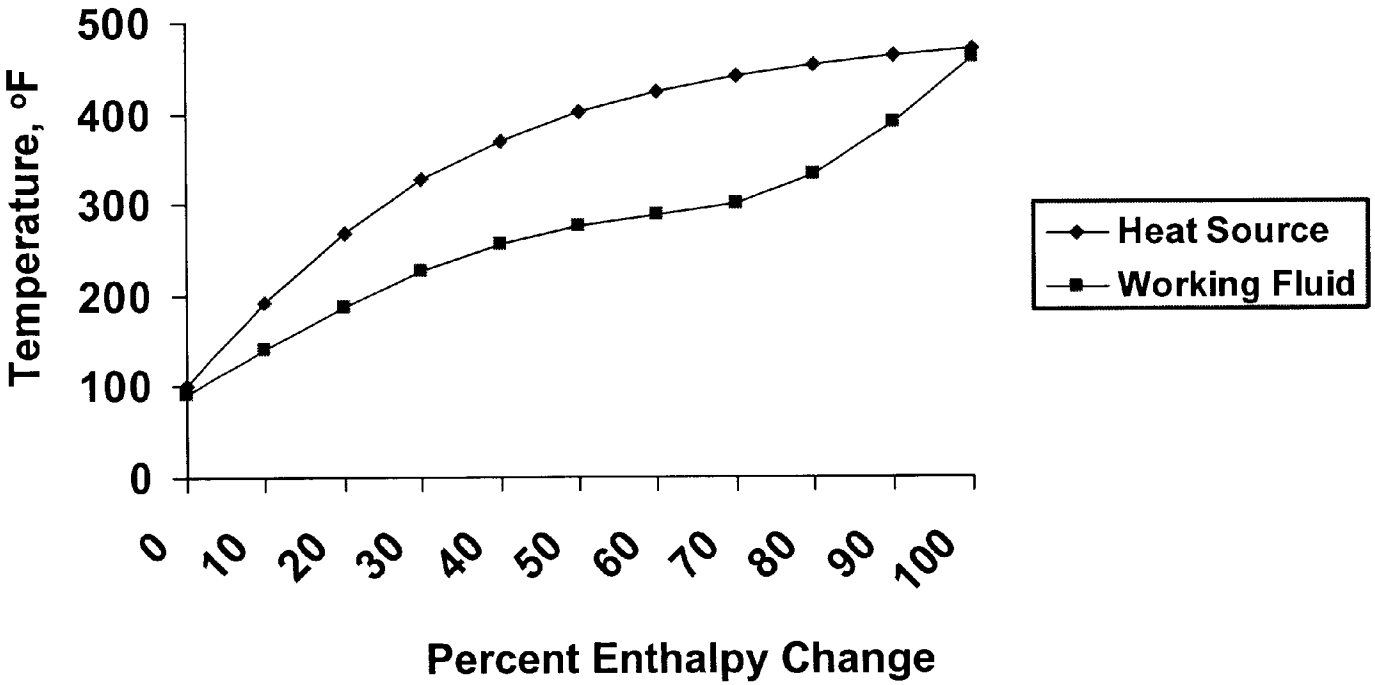
FIG. 3 is a graph of the heat source stream temperature and the working fluid stream temperature during heat exchange in Example II.

Quenched gas, when cooled, does not exhibit the same linear change in temperature as the hot water stream used as the heat source in Example I. Instead, the removal of heat produces very little change in temperature at first, followed by a rapid acceleration of temperature loss as the quantity of water vapor in the gas is depleted. FIG. 3 shows the internal temperature profile along the length of the heat exchanger in this example. The smoothly curving line for the heat source illustrates this property of the quenched gas. Because the heat source's line and the working fluid's line curve away from each other in the middle of the heat exchanger, it is possible to specify an exchanger design in which the endpoints are very close to each other in temperature difference. For this example, a temperature difference of 10° F. was chosen for both the cold end and the hot end of the exchanger. Even with this narrow difference at the endpoints, the average log mean temperature difference over the whole exchanger is a quite acceptable value of 67° F.

The advantage of quenched gas as a heat source is twofold. The working fluid can be heated to a higher temperature, resulting in higher expansion turbine efficiency and output, and the heat source can be cooled to a lower temperature, resulting in more heat being recovered. The overall effect is a greater power output and a higher thermal efficiency than would be possible with heat source streams of equal temperature in the forms of liquids or non-condensing gases. Or, expressed in another way, the quenched gas from a gasifier is an excellent match as a heat source for the present invention, and thus represents an important specific application for which the present invention is intended.

The working fluid of choice for this example is ammonia. A working fluid pressure of 1900 psia is selected, which, upon expansion in expansion turbine 106 at an initial 461° F., yields a modest and acceptable level of 0.1 percent liquid in the turbine exhaust. The circulation rate of the working fluid is selected to provide, with benefit of properly sized heat exchange equipment, a 10° F. temperature difference at the cold end of the heat exchanger. This is calculated to be about 933,400 pounds per hour. The cooling of the heat source stream to this 10° F. difference resulted in over 95 percent of the available heat being removed.

During normal and steady state operation of the present invention, the operating conditions at points throughout the cycle are as follows (see FIG. 1 for references to line and equipment designation numbers). Stream 104 emerges from heat exchanger 101 at a temperature of 461° F. having been heated by the 471° F. heat source stream. Simultaneously, the heat source stream is cooled to about 100° F., and more than 99 percent of the water vapor in the stream is condensed. Valve 113 is fully closed and valve 105 is fully open. At the calculated design flow rate of 933,400 pounds per hour for stream 104, expansion turbine 106 by virtue of its design provides resistance to flow such that the pressure in stream 104 is maintained at about 1900 psia. Upon expansion of stream 104 through expansion turbine 106 to a pressure of 167 psia, the working fluid, having been cooled by work of expansion, emerges saturated at 85° F. and contains about 0.1 percent liquid of condensation (stream 108). These conditions are calculated on the basis of obtaining 85 percent of the theoretical power from the isentropic expansion of ammonia. Gross power generated at the shaft of expansion turbine 106 is 38,628 kW. No power is deducted for generator losses because no generator is used. Instead the power output is used to assist the electric motor drive for the main air compressor in the air separation plant. Stream 108 is condensed in condenser 109 at a temperature of 85° F. by an external cooling source (such as cooling water at 60° F.). The pressure at which ammonia condenses at 85° F. is 167 psia, which sets the pressure at the discharge of expansion turbine 106. The working fluid liquid is also subcooled in condenser 109 to a temperature of 83° F. No accumulation or loss of fluid occurs in surge vessel 110 at steady state. Pump 111 is a centrifugal type that provides a flow rate and discharge pressure as prescribed by the pump's performance curve. A centrifugal type is selected because it is practical for the relatively large flow rate (about 3000 gallons per minute) found in this example. A flow control valve 112 downstream of the pump is partially closed to limit the discharge flow from pump 111 to the desired flow rate of 933,400 pounds per hour. Pump 111 increases the pressure of the working fluid to 1930 psia, which is 30 psi above the pressure at the entrance to expansion turbine 106. This 30 psi difference is to allow for three separate pressure drops between pump 111 and expansion turbine 106: (1) 20 psi for the loss through the flow control valve 112 downstream of pump 111, (2) 5 psi for losses in heat exchanger 101, and (3) 5 psi for the losses in the piping between the heat exchanger and the expansion turbine. This additional 5 psi loss in the piping, which was not used in Example I, is to account for the expected long run of piping between the gasification area and the air separation unit. Electric power consumed by the drive motor of pump 111 is 3330 kW. The mechanical act of pumping the working fluid warms it slightly to about 90° F. from 83° F. Thus stream 103 has conditions of 90° F. and 1910 psia as it enters heat exchanger 101, completing the cycle as described.

The calculated performance numbers for Example II are as follows:

Gross expansion turbine power output=38,628 kW (unadjusted power output; no generator loss is included since no generator is used)

Gross pumping power used=3330 kW

Net power=35,298 kW

Thermal efficiency=19.6 percent

EXAMPLE III

Example III illustrates the case of extracting heat from the hot exhaust stream of a combustion turbine unit. In other words, the present invention is applied as the bottoming cycle of a combined cycle unit. The type of combustion turbine selected for this example is one in which the compressed air stream feeding the burner and combustion turbine is recuperated, i.e., the air is preheated by heat exchange with the hot exhaust coming directly from the combustion turbine. This exchange of heat leaves the final exhaust stream significantly cooler than exhaust streams from non-recuperated cycles, which typically have exhaust temperatures above 900° F.

A commercial gas turbine, the Solar® Mecury™ 50, was selected as the basis for this example. At design rated conditions, the Mercury 50 has a net output of 4180 kW. Exhaust flow is 129,190 lb/h at a temperature of 694° F. This combination of moderate exhaust temperature and relatively small size are a good match for the capabilities of the present invention.

The working fluid of choice for this example is ammonia. The design parameters are selected as follows. A temperature of 644° F. is selected for the working fluid, which, given the 694° F. temperature of the heat source, provides an adequate temperature difference of 50° F. for heat transfer at the hot end of the exchanger. Because of the high temperature of the working fluid, it is not considered practical to select a pressure sufficiently high to expand the working fluid to condensing conditions. Such a pressure would exceed 4500 psia and may approach or be beyond the state-of-the-art for mechanical design. A pressure of 3500 psia is used instead, which is typical for commercial high pressure steam turbines. Finally, the circulation rate of the working fluid is selected to provide, with benefit of properly sized heat exchange equipment, a 50° F. temperature difference at the cold end of the heat exchanger. This rate is calculated to be about 24,300 pounds per hour. Overall, the weighted log mean temperature difference between the two fluids being exchanged is about 66° F., very adequate for commercial design. About 84 percent of the heat in the heat source stream is removed.

During normal and steady state operation of the present invention, the operating conditions at points throughout the cycle are as follows (see FIG. 1 for references to line and equipment designation numbers). Stream 104 emerges from heat exchanger 101 at a temperature of 644° F. having been heated by the 694° F. heat source stream. Valve 113 is fully closed and valve 105 is fully open. At the calculated design flow rate of 24,300 pounds per hour for stream 104, the expansion turbine 106 by virtue of its design provides resistance to flow such that the pressure in stream 104 is maintained at about 3500 psia. Upon expansion of stream 104 through expansion turbine 106 to a pressure of 167 psia, the working fluid, having been cooled by work of expansion, emerges at a temperature of 144° F. (stream 108). These conditions are calculated on the basis of obtaining 85 percent of the theoretical power from the isentropic expansion of ammonia. Gross power generated at the shaft of expansion turbine 106 is 1495 kW. After deducting 2 percent for losses in the generator, gross electric power output from generator 107 is 1465 kW. Stream 108 is cooled from 144° F. to its saturation temperature of 85° F. and condensed in condenser 109 by an external cooling source (such as cooling water at 60° F.). The pressure at which ammonia condenses at 85° F. is 167 psia, which sets the pressure at the discharge of expansion turbine 106. The working fluid liquid is also subcooled in condenser 109 to a temperature of 83° F. No accumulation or loss of fluid occurs in surge vessel 110 at steady state. Pump 111 increases the pressure of the working fluid to 3505 psia, which is 5 psi above the pressure at the entrance to expansion turbine 106. This 5 psi difference is to allow for a pressure drop due to flow of the working fluid through heat exchanger 101 and the attendant piping. Pump 111 is a type that provides a fixed volume of liquid per revolution of its drive shaft (i.e., a positive displacement pump). The prescribed circulation rate of 24,300 pounds per hour is set by controlling the rotational speed of the drive shaft of pump 111. Electric power consumed by the drive motor of pump 111 is about 164 kW. The mechanical act of pumping the working fluid warms it to about 96° F. from 83° F. Thus stream 103 has conditions of 96° F. and 3505 psia as it enters heat exchanger 101, completing the cycle as described.

The calculated performance numbers for Example III are summarized as follows:

Gross electric power output=1465 kW

Gross pumping power used=164 kW

Net power=1301 kW

Thermal efficiency=20.9 percent

EXAMPLE IV

As in Example III, Example IV illustrates the case of extracting heat from the hot exhaust stream of a combustion turbine unit. In this example, however, the combustion turbine is employed to rapidly provide supplemental electric power during intermittent periods in which electric power demand is unusually high. This supplemental electric power is commonly referred to in the electric utility industry as peak load. The combustion turbines used to generate power during peak load are called peaking units. As those persons skilled in the art of power generation by an electric utility will appreciate, the present invention has operational characteristics which are advantageous to the generation of peak load power, including (1) rapid and simple startup and (2) non-interference with the operation or power output of the peaking unit.

This example also illustrates the use of sulfur dioxide as a working fluid and compares its performance and operational characteristics with ammonia as a working fluid.

The combustion turbine in this example is a General Electric Model PG7121(EA), a model typical of peaking units used by large electric utilities. It is assumed for this example that the PG7121(EA) is operating under hot summertime conditions in which the ambient temperature is 95° F. Hot weather is one of the most common times when peak load power production is needed by a utility. Hot weather is also the most difficult of conditions under which to generate peak load power because the combustion turbine, which relies on ambient air for its working fluid and as a source of oxygen for combustion, produces less power than it would operating under moderate or cold ambient temperatures.

Hot summertime conditions are also a more difficult application for the present invention because the external coolant used in the condenser will also be hotter. To reflect this difference, it is assumed for this example that condensation of the working fluid takes place at 105° F. rather than the 85° F. temperature used in the previous three examples.

At 95° F. ambient temperature, our estimate shows that the PG7121(EA) produces an exhaust stream of about 2,215,000 pounds per hour at a temperature of 994° F. Those skilled in the art will readily recognize that for a heat source stream of such large mass flow and high temperature, a bottoming cycle with steam as the working fluid (and utilizing two or three boiler pressures with reheat of the steam in between boiler stages) would normally be more economic and efficient than that offered by the present invention. However, such as team cycle lacks the characteristics needed for peak load power generation. Startup of a steam cycle is slow and labor intensive. Under peak load power demand conditions, in which combustion turbines are started from a remote control room as needed to fulfill power demand, a bottoming cycle is needed which, similar to the combustion turbines, can be started quickly and automatically by sending a start signal from a distant control room.

The design parameters in this example are as follows. The operating pressure and temperature of the working fluid as it leaves heat exchange with the heat source stream are set at 2800 psia and 700° F. These figures are based on practical and economic considerations of the materials of construction, that is, these figures are roughly the highest pressure and temperature which can be safely confined in a 16-inch, schedule 80 pipe (the approximate size for this application) made of Type 304 stainless steel, a commonly used and economic material for handling corrosive chemicals. Of course, this pressure and temperature selection is a rough approximation by way of illustration only. A detailed design and cost analysis will be needed to ascertain the most economic design.

Because of the high temperature difference between the heat source stream and the working fluid at the hot end of the heat exchanger (700° F. versus 994° F.), a relatively small temperature difference at the cold end of the exchanger is possible. A temperature difference of 10° F. is used. This small difference permits more heat to be extracted from the heat source stream and also provides an important additional benefit discussed in the next paragraph. With ammonia as the working fluid, the overall weighted log mean temperature difference between the two fluids being exchanged is a very acceptable 96° F., and no internal temperature difference is less than the 10° F. design figure at the cold end. Similarly, with sulfur dioxide as the working fluid, the overall weighted log mean temperature difference in the heat exchanger is a very acceptable 84° F., and no internal temperature difference is less than the 10° F. design figure at the cold end.

An important design consideration for a peak load power application is that the bottoming cycle should not interfere with the operation or performance of the combustion turbine. If heat exchange tubing were to be permanently installed in the flowpath of the combustion turbine exhaust gas as is normally done with a bottoming cycle, then a fixed pressure drop across the tubing is introduced into the design. Such a pressure drop would reduce the power output and efficiency of the combustion turbine whether the bottoming cycle was operated or not. This is unacceptable because the often short duration need to generate peak load power may in some cases not allow time to start the bottoming cycle. Nevertheless, the power loss experienced by the combustion turbine would always be present if the heat exchanger were present. The present invention provides a way to avoid this problem. A design configuration is used in which most of the combustion turbine exhaust is drawn by an induced draft fan (device 115 in FIG. 1) into a separate duct system which contains the heat exchange unit. The exhaust gas that is not drawn into the duct, if any, is discharged along its normal flowpath to the atmosphere. The induced draft fan is located downstream of the heat exchange unit where the exhaust gas has been cooled. As those skilled in the art will appreciate, the very low temperature difference of 10° F. at the cold end of the heat exchanger with the present invention causes the exhaust gas to be as cold as practicable and thus, in turn, lowers the power usage by the fan to as low as practicable. From the perspective of the overall system, the power consumed by the fan is slightly less than the power that would have been lost (i.e., not generated) in a system without a fan.

Two working fluids, sulfur dioxide and ammonia, are presented and compared in this example. For any given set of operating conditions of the present invention, sulfur dioxide always produces more net power than ammonia. However, for low or moderate temperature applications such as those presented in Examples I and II, where the heat source temperature is less than 600° F., sulfur dioxide is problematic from a mechanical design standpoint because of condensation that occurs inside the expansion turbine. However, for this example, where the heat source temperature is high, the expansion turbine exhaust temperature is raised, thereby avoiding condensation.

Table III compares the properties of the two working fluids and illustrates the difference in the two fluids under different operating conditions.

TABLE III

| | Sulfur Dioxide | Ammonia |
|---|---|---|
| Critical temperature, ° F. | 316 | 270 |
| Critical pressure, psia | 1143 | 1636 |
| Condensing pressure @ 85° F., psia | 65 | 167 |
| Condensing pressure @ 105° F., psia | 93 | 231 |
| Percent liquid in expansion turbine outlet, after expansion from 1800 psia, 450° F. to the condensing pressure at 85° F. | 13.7 | <0.1 |
| Percent liquid in expansion turbine outlet, after expansion from 2800 psia, 700° F. to the condensing pressure at 105° F. | None (169° F. outlet temperature) | None (270° F. outlet temperature) |

The last two rows of figures in Table III illustrate the advantage of sulfur dioxide over ammonia in a high temperature application such as that presented in this example. Sulfur dioxide cools more than ammonia during expansion, hence more energy is converted to power with sulfur dioxide. At a relatively cool inlet temperature for the expansion turbine (450° F.), this property of sulfur dioxide produces a large quantity of liquid (13.7 percent) in the expansion turbine exhaust. In contrast, ammonia produces almost no condensation in the expansion turbine. At a higher initial temperature, however, this advantage for ammonia becomes a disadvantage. As shown in the last row of the table, ammonia only cools to 270° F., which leaves a significant quantity of heat unconverted to power. This unused heat simply adds to the burden of heat rejection to the environment which occurs in the condenser.

During normal and steady state operation of the present invention with sulfur dioxide as the working fluid, the operating conditions at points throughout the cycle are as follows (see FIG. 1 for references to line and equipment designation numbers). Stream 104 emerges from heat exchanger 101 at a temperature of 700° F. having been heated by the 994° F. heat source stream. Valve 113 is fully closed and valve 105 is fully open. At the calculated design flow rate of 2,285,000 pounds per hour for stream 104, the expansion turbine by virtue of its design provides resistance to flow such that the pressure in stream 104 is maintained at about 2800 psia. Upon expansion of stream 104 through expansion turbine 106 to a pressure of 93 psia, the working fluid, having been cooled by work of expansion, emerges at a temperature of 169° F. (stream 108). These conditions are calculated on the basis of obtaining 85 percent of the theoretical power from the isentropic expansion of sulfur dioxide. Gross power generated at the expansion turbine shaft is 43,388 kW. After deducting 2 percent for losses in the generator, gross electric power output from generator 107 is 42,520 kW. Stream 108 is cooled from 169° F. to its saturation temperature of 105° F. and condensed in condenser 109 by an external cooling source (such as cooling water at 80° F.). The pressure at which sulfur dioxide condenses at 105° F. is 93 psia, which sets the pressure at the discharge of expansion turbine 106. The working fluid liquid is also subcooled in condenser 109 to a temperature of 103° F. No accumulation or loss of fluid occurs in surge vessel 110 at steady state. Pump 111 is a centrifugal type that provides a flow rate and discharge pressure as prescribed by the pump's performance curve. A centrifugal type is selected because it is practical for the relatively large flow rate (about 3200 gallons per minute) found in this example. A flow control valve 112 downstream of the pump is partially closed to limit the discharge flow from pump 111 to the desired flow rate of 2,285,000 pounds per hour. Pump 111 increases the pressure of the working fluid to 2825 psia, which is 25 psi above the pressure at the entrance to expansion turbine 106. This 25 psi difference is to allow for two separate pressure losses between pump 111 and expansion turbine 106: (1) 20 psi for the loss through the flow control valve downstream of pump 111, and (2) 5 psi for losses in heat exchanger 101. Electric power consumed by the drive motor of pump 111 is about 5697 kW. The mechanical act of pumping the working fluid warms it to about 120° F. from 103° F. The heat source stream leaving heat exchanger 101, stream 114, is cooled to within 10° F. of the working fluid, or about 130° F. Using an estimated 0.6 psi pressure drop for the heat source stream as it passes through heat exchanger 101, the power required by the induced draft fan, equipment item 115, is estimated to be 1552 kW. Stream 103 has conditions of 120° F. and 2805 psia as it enters heat exchanger 101, completing the cycle as described.

During normal and steady state operation of the present invention with ammonia as the working fluid, the operating conditions at points throughout the cycle are as follows (see FIG. 1 for references to line and equipment designation numbers). Stream 104 emerges from heat exchanger 101 at a temperature of 700° F. having been heated by the 994° F. heat source stream. Valve 113 is fully closed and valve 105 is fully open. At the calculated design flow rate of 643,000 pounds per hour for stream 104, the expansion turbine by virtue of its design provides resistance to flow such that the pressure in stream 104 is maintained at aboutly 2800 psia. Upon expansion of stream 104 through expansion turbine 106 to a pressure of 231 psia, the working fluid, having been cooled by work of expansion, emerges at a temperature of 270° F. (stream 108). These conditions are calculated on the basis of obtaining 85 percent of the theoretical power from the isentropic expansion of ammonia. Gross power generated at the expansion turbine shaft is 38,535 kW. After deducting 2 percent for losses in the generator, gross electric power output from generator 107 is 37,765 kW. Stream 108 is cooled from 270° F. to its saturation temperature of 105° F. and condensed in condenser 109 by an external cooling source (such as cooling water at 80° F.). The pressure at which ammonia condenses at 105° F. is 231 psia, which sets the pressure at the discharge of expansion turbine 106. The working fluid liquid is also subcooled in condenser 109 to a temperature of 103° F. No accumulation or loss of fluid occurs in surge vessel 110 at steady state. Pump 111 is a centrifugal type that provides a flow rate and discharge pressure as prescribed by the pump's performance curve. A centrifugal type is selected because it is practical for the relatively large flow rate (about 2100 gallons per minute) found in this example. A flow control valve 112 downstream of the pump is partially closed to limit the discharge flow from pump 111 to the desired flow rate of 643,000 pounds per hour. Pump 111 increases the pressure of the working fluid to 2825 psia, which is 25 psi above the pressure at the entrance to expansion turbine 106. This 25 psi difference is to allow for two separate pressure losses between pump 111 and expansion turbine 106: (1) 20 psi for the loss through the flow control valve 112 downstream of pump 111, and (2) 5 psi for losses in heat exchanger 101. Electric power consumed by the drive motor of pump 111 is about 3483 kW. The mechanical act of pumping the working fluid warms it to about 115° F. from 103° F. The heat source stream leaving heat exchanger 101, stream 114, is cooled to within 10° F. of the working fluid, or about 125° F. Using an estimated 0.6 psi pressure drop for the heat source stream as it passes through heat exchanger 101, the power required by the induced draft fan, equipment item 115, is estimated to be 1540 kW. Stream 103 has conditions of 115° F. and 2805 psia as it enters heat exchanger 101, completing the cycle as described.

The calculated performance numbers for Example IV with sulfur dioxide as the working fluid are summarized as follows:

Gross electric power output=42,520 kW
Gross pumping power used=5697 kW
Gross power used by the induced draft fan=1552 kW
Net power=35,271 kW
Thermal efficiency=21.4 percent
With ammonia as the working fluid:
Gross electric power output=37,765 kW
Gross pumping power used=3483 kW
Gross power used by the induced draft fan=1540 kW
Net power=32,742 kW
Thermal efficiency=19.8 percent

EXAMPLE V

This example illustrates a general case in which the heat source stream temperature is too low for practical operation with ammonia as the working fluid. A pressurized stream of hot water in the liquid state at 200 psia, 300° F. and flowing at a rate of 1000 gallons per minute was selected to represent the heat source. Although ammonia is theoretically applicable as a working fluid because the heat source temperature of 300° F. exceeds ammonia's critical temperature (270° F.), ammonia is highly impractical because the initially cold temperature results in a large amount of condensation of ammonia (>30 percent liquid) inside the expansion turbine. Instead of ammonia, the working fluid of choice for this example is chlorodifluoromethane.

Chlorodifluoromethane, which has the chemical formula $CHClF_2$, is commonly used in industrial and residential cooling applications as a refrigerant and has the refrigerant designation R-22. Chlorodifluoromethane has a relatively low critical temperature (205° F.) and a relatively low critical pressure (721 psia), which make it ideal for relatively cold heat source streams. At a condensing temperature of 85° F., Chlorodifluoromethane condenses at a pressure of 172 psia, which is similar to that for ammonia (167 psia).

As with Example I, only three process design parameters need be selected for the cycle: (1) the temperature of the working fluid as it leaves heat exchange (stream 104 in FIG. 1), (2) the maximum pressure of the working fluid, and (3) the circulation rate of the working fluid. A temperature of 270° F. is selected for the working fluid, which, given the 300° F. temperature of the heat source, provides an adequate temperature difference of 30° F. for heat transfer at the hot end of the exchanger. A working fluid pressure of 865 psia is selected, which, upon expansion in the expansion turbine at an initial 270° F., yields a modest and acceptable level of 0.1 percent liquid in the expansion turbine exhaust. Finally, the circulation rate of the working fluid was selected to provide, with benefit of properly sized heat exchange equipment, a 50° F. temperature difference at the cold end of the heat exchanger. This rate is calculated to be about 888,200 pounds per hour.

During normal and steady state operation of the present invention, the operating conditions at points throughout the cycle are as follows (see FIG. 1 for references to line and equipment designation numbers). Stream 104 emerges from heat exchanger 101 at a temperature of 270° F. having been heated by the 300° F. heat source stream. Valve 113 is fully closed and valve 105 is fully open. At the calculated design flow rate of 888,200 pounds per hour for stream 104, the expansion turbine by virtue of its design provides resistance to flow such that the pressure in stream 104 is maintained at about 865 psia. Upon expansion of stream 104 through expansion turbine 106 to a pressure of 172 psia, the working fluid, having been cooled by work of expansion, emerges saturated at 85° F. and contains about 0. 1 percent liquid of condensation (stream 108). These conditions are calculated on the basis of obtaining 85 percent of the theoretical power from the isentropic expansion of chlorodifluromethane. Gross power generated at the shaft of expansion turbine 106 is 3646 kW. After deducting 2 percent for losses in the generator, gross electric power output from generator 107 is 3573 kW. Stream 108 is condensed in condenser 109 at a temperature of 85° F. by an external cooling source (such as cooling water at 60° F.). The pressure at which chlorodifluromethane condenses at 85° F. is 172 psia, which sets the pressure at the discharge of expansion turbine 106. The working fluid liquid is also subcooled in condenser 109 to a temperature of 83° F. No accumulation or loss of fluid occurs in surge vessel 110 at steady state. Pump 111 increases the pressure of the working fluid to 870 psia, which is 5 psi above the pressure at the entrance to expansion turbine 106.

This 5 psi difference is to allow for a pressure drop due to flow of the working fluid through heat exchanger 101 and the attendant piping. Pump 111 is a type that provides a fixed volume of liquid per revolution of its drive shaft (i.e., a positive displacement pump). The prescribed circulation rate of 888,200 pounds per hour is set by controlling the rotational speed of the drive shaft of pump 111. Electric power consumed by the drive motor of pump 111 is about 634 kW. The mechanical act of pumping the working fluid warms it slightly to about 92° F. from 83° F. Thus stream 103 has conditions of 92° F. and 870 psia as it enters heat exchanger 101, completing the cycle as described.

Figure 4:
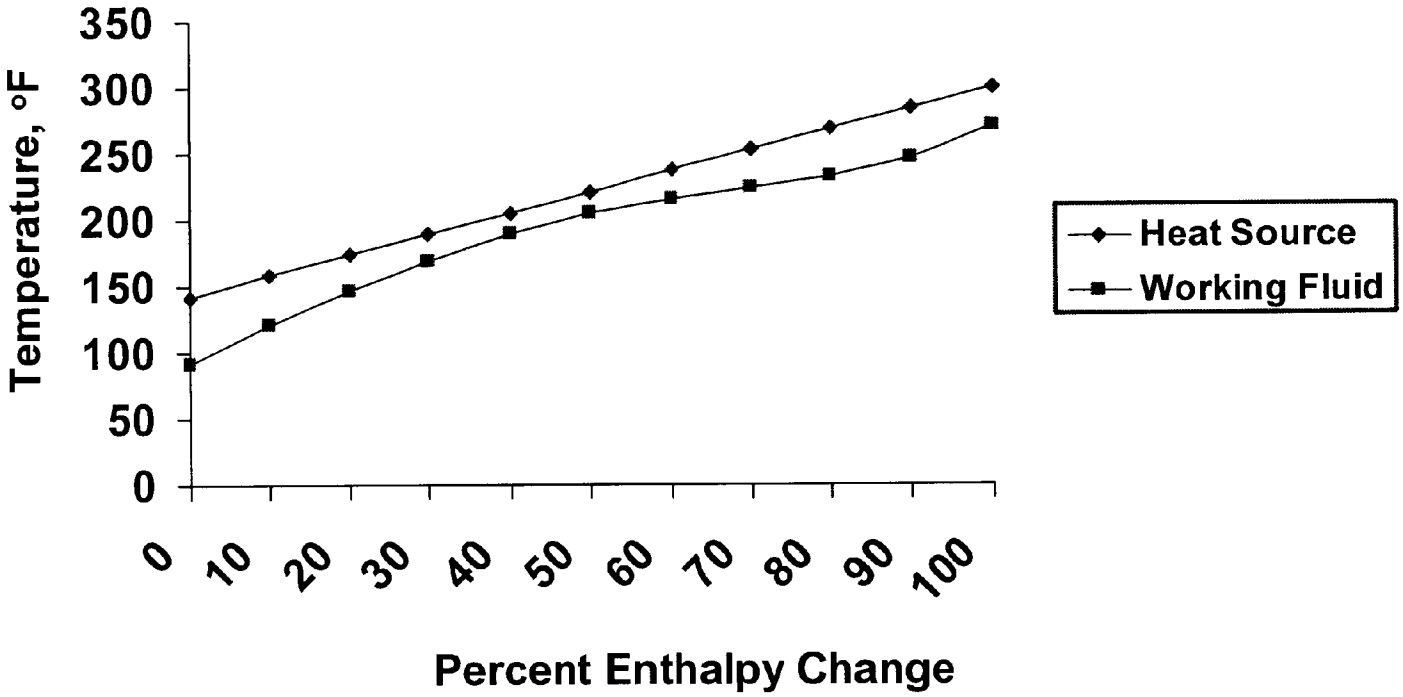
FIG. 4 is a graph of the heat source stream temperature and the working fluid stream temperature during heat exchange in Example V.

FIG. 4 shows the internal temperature profile along the length of the heat exchanger in this example. Temperature differences between the two streams remain acceptable throughout the exchanger. The smallest temperature difference between the two streams is about 17° F., and the largest is about 50° F. The log mean temperature difference (LMTD) weighted over the length of the exchanger is about 26° F. Overall, FIG. 4 demonstrates the general acceptability of countercurrent exchange used by the present invention. About 73 percent of the heat in the heat source stream is removed.

The calculated performance numbers for Example V are as follows:

Gross electric power output=3573 kW

Gross pumping power used=634 kW

Net power=2939 kW

Thermal efficiency=9.2 percent

INVENTION PARAMETERS

After sifting and winnowing through the data from our process simulations of the present invention herein presented, as well as other process simulations and economic studies of the instant, new, novel, and improved process, including methods and means for effecting thereof, the operating variables, including the acceptable and preferred conditions for carrying out the instant, new, and novel invention, are summarized in Table IV below.

TABLE IV

| VARIABLES | OPERATING LIMITS | PREFERRED LIMITS | MOST PREFERRED LIMITS* |
|---|---|---|---|
| Heat source temperature, stream 102 | >210° F.** | 290–1100° F. | 500–700° F. |
| Working fluid temperature, stream 104 | 200–1000° F. | 270–700° F. | 450–550° F. |
| Working fluid pressure, stream 104 | 450–3500 psia | 760–3500 psia | 1800–2400 psia |
| Condensing temperature | 60–140° F. | 70–105° F. | 75–85° F. |
| Percent liquid in expansion turbine outlet | <20 | <0.1 | 0 |
| Net power output | >0.5 MW | 1–50 MW | 24 MW |

*The most preferred limits refer specifically to those applications in which ammonia is used as the working fluid and in which the equipment of the present invention (except for heat exchanger) is mounted on a single portable skid.

**The temperature of the heat source is limited by way of the practical and economic consideration of the cost and availability of the materials of construction and not limited by way of the process.

While we have shown and described particular embodiments of this invention, modifications and variations thereof will occur to those skilled in the art. It is to be understood therefore that the appended claims are intended to cover such modifications and variations which are within the true scope and spirit of this invention.

What is claimed:

1. A thermodynamic power cycle system for extracting a flow of heat from a heat source stream and generating mechanical power from the flow of heat by means of a working fluid flowing within a closed-loop cycle, said system comprising:

means for transferring heat from the heat source stream to the working fluid such that the working fluid warms from a first temperature to a second temperature that is more than 30° F. greater than the critical temperature of the working fluid, wherein the working fluid has a critical temperature more than 40° F. lower than a temperature of the heat source stream and has a normal boiling point less than 32° F.;

means for expanding the working fluid and converting work of expansion of the working fluid to mechanical power; said means for expanding and converting work of expansion also throttling the working fluid such that a pressure of the working fluid exceeds the critical pressure of the working fluid by an amount greater than 5% of the critical pressure of the working fluid as the working fluid emerges from the means for transferring heat;

means for cooling to condense and subcool the working fluid after the means for expanding; and means for returning the working fluid to the means for transferring heat; and an additional means for throttling the working fluid after the means for transferring heat and before the means for expanding, wherein the means for transferring heat, the means for expanding, the means for cooling, and the means for returning the working fluid to the means for transferring heat are the only four means in which energy is removed from or transferred into the working fluid in the form of heat or work.

2. The thermodynamic power cycle system of claim 1, wherein the heat source stream comprises a gas, liquid, solid or mixture thereof.

3. The thermodynamic power cycle system of claim 1, further comprising means for controlling the flow rate of the working fluid.

4. The thermodynamic power cycle system of claim 1, further comprising means for containing excess of the working fluid in the liquid state after the means for cooling to condense the working fluid.

5. The thermodynamic power cycle system of claim 1, wherein the working fluid is ammonia, chlorodifluoromethane, sulfur dioxide or bromotrifluoromethane.

6. The thermodynamic power cycle system of claim 1, wherein the working fluid is ammonia.

7. The thermodynamic power cycle system of claim 1, wherein the working fluid is chlorodifluoromethane.

8. The thermodynamic power cycle system of claim 1, wherein the heat source stream is a gas which contains a condensable vapor.

9. The thermodynamic power cycle system of claim 1, wherein the heat source stream is generated by a topping cycle.

10. The thermodynamic power cycle system of claim 1, further comprising means for redirecting the flow of the working fluid after the working fluid has exited the means for transferring heat to bypass the means for expanding, the means for redirecting the flow containing a means for throttling the working fluid such that a pressure of the working fluid exceeds the critical pressure of the working fluid by an amount greater than 5% of the critical pressure of the working fluid as the working fluid emerges from the means for transferring heat.

11. The thermodynamic power cycle system of claim 10, which comprises two or more heat source streams, with the thermodynamic power cycle system comprising additional means for transferring heat, each of which means for transferring heat is dedicated to a single heat source stream; wherein the working fluid is divided into separate streams, with each of the separate streams of working fluid being dedicated to a separate means for transferring heat; and wherein the separate streams of working fluid, after having been heated by transfer of heat from the heat source streams, are combined into a single working fluid stream.

12. The thermodynamic power cycle system of claim 10, wherein all means of the system except for the means for transferring heat are mounted on one or more portable transportation means, wherein the mechanical power is 4 MW or less, and wherein there is only one portable transportation means.

13. The thermodynamic power cycle system of claim 10, wherein the heat source stream is a stream of pressurized hot gas which has been quenched in water.

14. The thermodynamic power cycle system of claim 13, wherein the stream of pressurized hot gas has been produced by the reaction of coal and oxygen in a coal gasifier.

15. The thermodynamic power cycle system of claim 10, wherein the heat source stream is generated by a topping cycle, and wherein the topping cycle comprises a combustion turbine and wherein the heat source stream is exhaust gas from a combustion turbine.

16. The thermodynamic power cycle system of claim 15, further comprising means for increasing the pressure of the heat source stream to restore pressure lost by the heat source stream as it flows through the means for transferring heat, wherein the heat source stream is a gas, and wherein the thermodynamic power cycle system further comprises ducting means to transport the gas to the means for transferring heat and wherein the means for increasing the pressure is a fan or compressor.

17. The thermodynamic power cycle system of claim 16, wherein the combustion turbine is a peaking unit.

18. The thermodynamic power cycle system of claim 16, wherein the exhaust gas has been partially cooled by heat exchange with compressed air.

19. A thermodynamic power cycle system for extracting a flow of heat from a heat source stream and generating mechanical power from the flow of heat by means of a working fluid flowing within a closed-loop cycle, said system comprising:

means for transferring heat from the heat source stream to the working fluid such that the working fluid warms from a first temperature to a second temperature that is more than 30° F. greater than the critical temperature of the working fluid, wherein the working fluid has a critical temperature more than 40° F. lower than a temperature of the heat source stream and has a normal boiling point less than 32° F.;

means for expanding the working fluid and converting work of expansion of the working fluid to mechanical power; said means for expanding and converting work of expansion also throttling the working fluid such that a pressure of the working fluid exceeds the critical pressure of the working fluid by an amount greater than 5% of the critical pressure of the working fluid as the working fluid emerges from the means for transferring heat;

means for cooling to condense and subcool the working fluid after the means for expanding;

means for returning the working fluid to the means for transferring heat;

wherein the means for transferring heat, the means for expanding, the means for cooling, and the means for returning the working fluid to the means for transferring heat are the only four means in which energy is removed from or transferred into the working fluid in the form of heat or work;

said thermodynamic power cycle system further comprising means for redirecting the flow of the working fluid after the working fluid has exited the means for transferring heat to bypass the means for expanding, the means for redirecting the flow containing a means for throttling the working fluid such that a pressure of the working fluid exceeds the critical pressure of the working fluid by an amount greater than 5% of the critical pressure of the working fluid as the working fluid emerges from the means for transferring heat.

20. The thermodynamic power cycle system of claim 19, wherein the heat source stream is a stream of pressurized hot gas which has been quenched in water, and wherein the stream of pressurized hot gas has been produced by the reaction of coal and oxygen in a coal gasifier.

21. The thermodynamic power cycle system of claim 19, wherein all means of the system except for the means for transferring heat are mounted on one or more portable transportation means, wherein the mechanical power is 4 MW or less, and wherein there is only one portable transportation means.

22. The thermodynamic power cycle system of claim 19, wherein the heat source stream is generated by a topping cycle, wherein the topping cycle comprises a combustion turbine and wherein the heat source stream is exhaust gas from a combustion turbine; and wherein the combustion turbine is a peaking unit.

23. The thermodynamic power cycle system of claim 22, further comprising means for increasing the pressure of the heat source stream to restore pressure lost by the heat source stream as it flows through the means for transferring heat, wherein the heat source stream is a gas, and wherein the thermodynamic power cycle system further comprises ducting means to transport the gas to the means for transferring heat and wherein the means for increasing the pressure is a fan or compressor.

24. A thermodynamic power cycle system for extracting a flow of heat from a heat source stream and generating mechanical power from the flow of heat by means of a working fluid flowing within a closed-loop cycle, said system comprising:

means for transferring heat from the heat source stream to the working fluid such that the working fluid warms from a first temperature to a second temperature that is more than 30° F. greater than the critical temperature of the working fluid, wherein the working fluid has a critical temperature more than 40° F. lower than a temperature of the heat source stream and has a normal boiling point less than 32° F.;

means for expanding the working fluid and converting work of expansion of the working fluid to mechanical power; said means for expanding and converting work of expansion also throttling the working fluid such that a pressure of the working fluid exceeds the critical pressure of the working fluid by an amount greater than 5% of the critical pressure of the working fluid as the working fluid emerges from the means for transferring heat;

means for cooling to condense and subcool the working fluid after the means for expanding; and means for returning the working fluid to the means for transferring heat;

wherein the means for transferring heat, the means for expanding, the means for cooling, and the means for returning the working fluid to the means for transferring heat are the only four means in which energy is removed from or transferred into the working fluid in the form of heat or work, and wherein said system further comprises two or more heat source streams, with the thermodynamic power cycle system comprising additional means for transferring heat, each of which means for transferring heat is dedicated to a single heat source stream; wherein the working fluid is divided into separate streams, with each of the separate streams of working fluid being dedicated to a separate means for transferring heat; and wherein the separate streams of working fluid, after having been heated by transfer of heat from the heat source streams, are combined into a single working fluid stream.

25. A thermodynamic power cycle system for extracting a flow of heat from a heat source stream and generating mechanical power from the flow of heat by means of a working fluid flowing within a closed-loop cycle, said system comprising:

means for transferring heat from the heat source stream to the working fluid such that the working fluid warms from a first temperature to a second temperature that is more than 30° F. greater than the critical temperature of the working fluid, wherein the working fluid has a critical temperature more than 40° F. lower than a temperature of the heat source stream and has a normal boiling point less than 39° F.;

means for expanding the working fluid and converting work of expansion of the working fluid to mechanical power; said means for expanding and converting work of expansion also throttling the working fluid such that a pressure of the working fluid exceeds the critical pressure of the working fluid by an amount greater than 5% of the critical pressure of the working fluid as the working fluid emerges from the means for transferring heat;

means for cooling to condense and subcool the working fluid after the means for expanding; and means for returning the working fluid to the means for transferring heat;

wherein the means for transferring heat, the means for expanding, the means for cooling, and the means for returning the working fluid to the means for transferring heat are the only four means in which energy is removed from or transferred into the working fluid in the form of heat or work, and wherein the heat source stream comprises a gas, liquid, solid or mixture thereof;

said thermodynamic power cycle system further comprising means for increasing the pressure of the heat source stream to restore pressure lost by the heat source stream as it flows through the means for transferring heat.

26. The thermodynamic power cycle system of claim 25, wherein the heat source stream is a gas, and wherein the thermodynamic power cycle system further comprises ducting means to transport the gas to the means for transferring heat and wherein the means for increasing the pressure is a fan or compressor.

27. The thermodynamic power cycle system of claim 26, wherein the heat source stream is generated by a topping cycle, wherein the topping cycle comprises a combustion turbine and wherein the heat source stream is exhaust gas from a combustion turbine; and wherein the combustion turbine is a peaking unit.

28. A thermodynamic power cycle system for extracting a thermodynamic power cycle system for extracting a flow of heat from a heat source stream and generating mechanical power from the flow of heat by means of a working fluid flowing within a closed-loop cycle, said system comprising:

means for transferring heat from the heat source stream to the working fluid such that the working fluid warms from a first temperature to a second temperature that is more than 30° F. greater than the critical temperature of the working fluid, wherein the working fluid has a critical temperature more than 40° F. lower than a temperature of the heat source stream and has a normal boiling point less than 32° F.;

means for expanding the working fluid and converting work of expansion of the working fluid to mechanical power; said means for expanding and converting work of expansion also throttling the working fluid such that a pressure of the working fluid exceeds the critical pressure of the working fluid by an amount greater than 5% of the critical pressure of the working fluid as the working fluid emerges from the means for transferring heat;

means for cooling to condense and subcool the working fluid after the means for expanding; and means for returning the working fluid to the means for transferring heat;

wherein the means for transferring heat, the means for expanding, the means for cooling, and the means for returning the working fluid to the means for transferring heat are the only four means in which energy is removed from or transferred into the working fluid in the form of heat or work, and wherein the working fluid is sulfur dioxide.

29. A thermodynamic power cycle system for extracting a flow of heat from a heat source stream and generating mechanical power from the flow of heat by means of a working fluid flowing within a closed-loop cycle, said system comprising:

means for transferring heat from the heat source stream to the working fluid such that the working fluid warms from a first temperature to a second temperature that is more than 30° F. greater than the critical temperature of the working fluid, wherein the working fluid has a critical temperature more than 40° F. lower than a temperature of the heart source stream and has a normal boiling point less than 32° F.;

means for expanding the working fluid and converting work of expansion of the working fluid to mechanical power; said means for expanding and converting work of expansion also throttling the working fluid such that a pressure of the working fluid exceeds the critical pressure of the working fluid by an amount greater than 5% of the critical pressure of the working fluid as the working fluid emerges from the means for transferring heat;

means for cooling to condense and subcool the working fluid after the means for expanding; and means for returning the working fluid to the means for transferring heat, wherein the means for transferring heat, the means for expanding, the means for cooling, and the means for returning the working fluid to the means for transferring heat are the only four means in which energy is removed from or transferred into the working fluid in the form of heat or work, and wherein all means of the system except for the means for transferring heat are mounted on one or more portable transportation means.

30. The thermodynamic power cycle system of claim 29, wherein the mechanical power is 4 MW or less and wherein there is only one portable transportation means.

31. The thermodynamic power cycle system of claim 30, wherein the working fluid is ammonia.

32. The thermodynamic power cycle system of claim 30, wherein the working fluid is chlorodifluoromethane.

33. A thermodynamic power cycle system for extracting a flow of heat from at heat source stream and generating mechanical power from the flow of heat by means of a working fluid flowing within a closed-loop cycle, said system comprising:

means for transferring heat from the heat source stream to the working fluid such that the working fluid warms from a first temperature to a second temperature that is more than 30° F. greater than the critical temperature of the working fluid, wherein the working fluid has a critical temperature more than 40° F. lower than a temperature of the heat source stream and has a normal boiling point less than 32° F.;

means for expanding the working fluid and converting work of expansion of the working fluid to mechanical power; said means for expanding and converting work of expansion also throttling the working fluid such that a pressure of the working fluid exceeds the critical pressure of the working fluid by an amount greater than 5% of the critical pressure of the working fluid as the working fluid emerges from the means for transferring heat;

means for cooling to condense and subcool the working fluid after the means for expanding; and means for returning the working fluid to the means for transferring heat;

wherein the means for transferring heat, the means for expanding, the means for cooling, and the means for returning the working fluid to the means for transferring heat are the only four means in which energy is removed from or transferred into the working fluid in the form of heat or work, wherein the heat source stream is a gas which contains a condensable vapor, and wherein the heat source stream is a stream of pressurized hot gas which has been quenched in water.

34. The thermodynamic power cycle system of claim 33, wherein the stream of pressurized hot gas has been produced by the reaction of coal and oxygen in a coal gasifier.

35. The thermodynamic power cycle system of claim 34, wherein the working fluid is ammonia.

36. The thermodynamic power cycle system of claim 34, wherein the mechanical power is utilized to provide supplemental drive power to an air compressor of an air separation unit, the air separation unit being employed to provide oxygen to the coal gasifier.

37. The thermodynamic power cycle system of claim 36, wherein the working fluid is ammonia.

38. A thermodynamic power cycle system for extracting a flow of heat from a heat source stream and generating mechanical power from the flow of heat by means of a working fluid flowing within a closed-loop cycle, said system comprising:

means for transferring heat from the heat source stream to the working fluid such that the working fluid warms from a first temperature to a second temperature that is more than 30° F. greater than the critical temperature of the working fluid, wherein the working fluid has a critical temperature more than 40° F. lower than a temperature of the heat source stream and has a normal boiling point less than 32° F.;

means for expanding the working fluid and converting work of expansion of the working fluid to mechanical power; said means for expanding and converting work of expansion also throttling the working fluid such that a pressure of the working fluid exceeds the critical pressure of the working fluid by an amount greater than 5% of the critical pressure of the working fluid as the working fluid emerges from the means for transferring heat;

means for cooling to condense and subcool the working fluid after the means for expanding; and means for returning the working fluid to the means for transferring heat, wherein the means for transferring heat, the means for expanding, the means for cooling, and the means for returning the working fluid to the means for transferring heat are the only four means in which energy is removed from or transferred into the working fluid in the form of heat or work, wherein the heat source is generated by a topping cycle, and wherein the topping cycle comprises a combustion turbine and wherein the heat source stream is exhaust gas from a combustion turbine.

39. The thermodynamic power cycle system of claim 38, wherein the combustion turbine is a peaking unit.

40. The thermodynamic power cycle system of claim 39, wherein the working fluid is sulfur dioxide.

41. The thermodynamic power cycle system of claim 39, wherein the working fluid is ammonia.

42. The thermodynamic power cycle system of claim 39, wherein the exhaust gas has been partially cooled by heat exchange with compressed air.

43. The thermodynamic power cycle system of claim 42, wherein the working fluid is ammonia.

44. A thermodynamic process for the production of mechanical power from a heat source stream of gas, liquid, solid, or mixture thereof, said process comprising:

a. transferring heat from the heat source stream to a working fluid; wherein the working fluid is at a pressure more than 5 percent greater than the critical pressure of the working fluid; wherein the working fluid is warmed to a temperature more than 30° F. greater than the critical temperature of the working fluid; and wherein the working fluid has a critical temperature more than 40° F. lower than the temperature of the heat source stream and the working fluid has a normal boiling point less than 32° F.;

b. expanding the working fluid to produce mechanical power;

c. cooling to condense and subcool the working fluid;

d. pressurizing the working fluid;

e. directing the flow of the working fluid in a continuous loop through the above described process steps a, b, c, d, in that order, and returning to step a to continue the continuous loop;

f. process steps a, b, c, and d being the only four process steps in which energy is removed from or transferred into the working fluid in the form of heat or work.

45. The process of claim 44, wherein the working fluid is ammonia, chlorodifluoromethane, sulfur dioxide or bromotrifluoromethane.

46. The process of claim 44, wherein the working fluid is ammonia.

47. The process of claim 44, wherein the working fluid is chlorodifluoromethane.

48. The process of claim 44, wherein the working fluid is sulfur dioxide.

* * * * *

UNITED STATES PATENT AND TRADEMARK OFFICE

CERTIFICATE OF CORRECTION

PATENT NO. : 6,751,959 B1 
DATED : June 22, 2004
INVENTOR(S) : Timmons S. McClanahan and Michael C. Crim It is certified that error appears in the above-identified patent and that said Letters Patent is hereby corrected as shown below:

Column 18,
Line 19, delete “pump 105”, and insert -- pump 111 --;

Column 22,
Line 55, delete “a remaintained”, and insert -- are maintained --;

Column 30,
Line 25, delete “as team”, and insert -- a steam --;

Column 33,
Line 6, delete “aboutly”, and insert -- about --;

Column 35,
Line 57, table IV, under “Most Preferred Limits:”, delete “24 MW”, and insert -- 2 - 4 MW --;

Column 39,
Line 47, delete “39° F”, and insert -- 32° F --;

Column 40,
Lines 20 and 21, delete the second occurrence of “a thermodynamic power cycle system for extracting”;
Line 66, delete “heart source”, and insert -- heat source --;

Column 42,
Line 57, delete “claim 39”, and insert -- claim 38 --.

Signed and Sealed this

Fifth Day of October, 2004

JON W. DUDAS
*Director of the United States Patent and Trademark Office*